US007749137B2

(12) United States Patent
Watt et al.

(10) Patent No.: US 7,749,137 B2
(45) Date of Patent: Jul. 6, 2010

(54) VARIABLE STRIDE EXERCISE DEVICE

(75) Inventors: Jonathan B. Watt, Broomfield, CO (US); Patrick A. Warner, Boulder, CO (US)

(73) Assignee: Nautilus, Inc., Vancouver, WA (US)

( * ) Notice: Subject to any disclaimer, the term of this patent is extended or adjusted under 35 U.S.C. 154(b) by 0 days.

(21) Appl. No.: 11/941,066

(22) Filed: Nov. 15, 2007

(65) Prior Publication Data

US 2008/0125291 A1 May 29, 2008

Related U.S. Application Data

(60) Provisional application No. 60/866,116, filed on Nov. 16, 2006, provisional application No. 60/871,732, filed on Dec. 22, 2006.

(51) Int. Cl.
*A63B 22/04* (2006.01)

(52) U.S. Cl. ..... 482/52; 482/57

(58) Field of Classification Search ..... 482/52, 482/57, 70

See application file for complete search history.

(56) References Cited

U.S. PATENT DOCUMENTS

| | | | |
|---|---|---|---|
| 219,439 | A | 9/1879 | Blend |
| 3,316,898 | A | 5/1967 | Brown |
| 4,632,385 | A | 12/1986 | Geraci |
| 4,679,786 | A | 7/1987 | Rodgers |
| 4,940,233 | A | 7/1990 | Bull et al. |
| 5,000,443 | A | 3/1991 | Dalebout et al. |
| 5,163,888 | A | 11/1992 | Stearns |
| 5,242,343 | A | 9/1993 | Miller |
| 5,279,529 | A | 1/1994 | Eschenbach |
| 5,299,993 | A | 4/1994 | Habing |
| 5,352,169 | A | 10/1994 | Eschenbach |
| 5,423,729 | A | 6/1995 | Eschenbach |
| 5,518,473 | A | 5/1996 | Miller |
| 5,529,555 | A | 6/1996 | Rodgers, Jr. |
| 5,549,526 | A | 8/1996 | Rodgers, Jr. |
| 5,562,574 | A | 10/1996 | Miller |
| 5,573,480 | A | 11/1996 | Rodgers, Jr. |
| 5,577,985 | A | 11/1996 | Miller |
| 5,653,662 | A | 8/1997 | Rodgers, Jr. |
| 5,685,804 | A | 11/1997 | Whan-Tong et al. |
| 5,759,136 | A | 6/1998 | Chen |
| 5,762,588 | A | 6/1998 | Chen |

(Continued)

OTHER PUBLICATIONS

International Search Report and Written Opinion dated May 22, 2008 of corresponding PCT International Patent Application No. PCT/US2007/084986 (6 pages).

(Continued)

*Primary Examiner*—Loan H Thanh
*Assistant Examiner*—Andrew M Tecco
(74) *Attorney, Agent, or Firm*—Dorsey & Whitney LLP

(57) ABSTRACT

A variable stride device may include right and left foot engagement members operatively coupled to right and left cam-link assemblies, respectively. The cam-link assemblies may each be operatively coupled to a rotating member, such as a crank assembly, and to right and left swing arms, respectively. The cam-link assemblies may each include a cam member and first and second links. A user may engage the foot engagement members to move the foot engagement members in a substantially constant or variable elliptical, pseudo-elliptical or other stride path. The variable stride device may further include a resistance system for resisting movement of the foot engagement members.

29 Claims, 28 Drawing Sheets

U.S. PATENT DOCUMENTS 5,766,113 A * 6/1998 Rodgers, Jr. ..... 482/52
5,772,558 A 6/1998 Rodgers, Jr.
5,779,598 A 7/1998 Lee
5,779,599 A 7/1998 Chen
5,788,610 A 8/1998 Eschenbach
5,792,026 A 8/1998 Maresh et al.
5,792,028 A 8/1998 Jarvie
5,792,029 A 8/1998 Gordon
5,803,871 A 9/1998 Stearns et al.
5,836,854 A 11/1998 Kuo
5,848,954 A 12/1998 Stearns et al.
5,857,941 A 1/1999 Maresh et al.
5,865,712 A * 2/1999 Chang ..... 482/57
5,876,307 A 3/1999 Stearns et al.
5,879,271 A 3/1999 Stearns et al.
5,882,281 A 3/1999 Stearns et al.
5,893,820 A 4/1999 Maresh et al.
5,895,339 A 4/1999 Maresh
5,899,833 A 5/1999 Ryan et al.
5,957,814 A 9/1999 Eschenbach
5,971,892 A 10/1999 Lee
5,993,359 A 11/1999 Eschenbach
6,027,431 A 2/2000 Stearns et al.
6,030,320 A 2/2000 Stearns et al.
6,042,512 A 3/2000 Eschenbach
6,045,488 A 4/2000 Eschenbach
6,090,013 A 7/2000 Eschenbach
6,171,217 B1 1/2001 Cutler
6,206,806 B1 3/2001 Chu
6,217,486 B1 4/2001 Rosenow
6,254,514 B1 7/2001 Maresh et al.
6,338,698 B1 1/2002 Stearns et al.
6,390,953 B1 5/2002 Maresh et al.
6,554,750 B2 4/2003 Stearns et al.
6,612,969 B2 9/2003 Eschenbach
6,689,019 B2 * 2/2004 Ohrt et al. ..... 482/52
6,719,666 B1 4/2004 Lo et al.
6,755,769 B2 6/2004 Johnston
6,846,272 B2 1/2005 Rosenow et al.
6,875,160 B2 4/2005 Watterson et al.
7,097,591 B2 8/2006 Moon
7,169,088 B2 * 1/2007 Rodgers, Jr. ..... 482/52
7,214,168 B2 * 5/2007 Rodgers, Jr. ..... 482/52
7,244,217 B2 * 7/2007 Rodgers, Jr. ..... 482/52
7,276,017 B2 * 10/2007 Chen ..... 482/52
7,316,632 B2 * 1/2008 Rodgers, Jr. ..... 482/52
7,341,542 B2 * 3/2008 Ohrt et al. ..... 482/52
7,462,134 B2 * 12/2008 Lull et al. ..... 482/52
7,530,930 B2 5/2009 Liao et al.
2001/0011053 A1 8/2001 Miller
2002/0142890 A1 * 10/2002 Ohrt et al. ..... 482/52
2004/0005960 A1 1/2004 Chang
2004/0132583 A1 * 7/2004 Ohrt et al. ..... 482/52
2004/0248704 A1 * 12/2004 Rodgers, Jr. ..... 482/83
2005/0043145 A1 2/2005 Anderson et al.
2005/0049117 A1 3/2005 Rodgers, Jr.
2005/0202939 A1 9/2005 Lull et al.
2006/0166791 A1 7/2006 Liao et al.

OTHER PUBLICATIONS

Nautilus, Inc. "Nautilus Pro Series Ellipticals", Brochure, 2 pages, 2004.
U.S. Appl. No. 12/636,814, Filed Dec. 14, 2009, Ohrt et al.

* cited by examiner

VARIABLE STRIDE EXERCISE DEVICE

CROSS-REFERENCE TO RELATED APPLICATIONS

This application claims under 35 U.S.C. §119(e) the benefit of U.S. Provisional Application No. 60/866,116, entitled "Variable Stride Exercise Device" and filed on Nov. 16, 2006, and the benefit of U.S. Provisional Application No. 60/871,732, entitled "Variable Stride Exercise Device" and filed on Dec. 22, 2006, which are hereby incorporated herein by reference in their entireties.

FIELD OF THE INVENTION

Aspects of the present invention relate to an exercise device, and in certain implementations to a striding exercise device that provides elliptical and pseudo-elliptical striding paths. Certain embodiments include a striding exercise device that accommodates a variety of stride lengths and/or allows stride length variation during use.

BACKGROUND

Many exercise devices, including striding devices, provide a fixed exercise motion. That is, the typical striding exercise device is a fixed path exercise device that constrains all users to a particular stride length and height selected by the manufacturer. Many such striding devices operate by providing a fixed distance for the forward and rearward movement of the foot engagement members created by fixedly attaching the foot engagement members in the forward and rearward ends to rotating crank arms or other similar components.

SUMMARY

One embodiment of an exercise machine may take the form of a striding exercise device including first and second rotatable members, first and second swing members, first and second cam members, first and second foot engagement members, and first, second, third and links.

The first cam member may be operatively associated with the first rotatable member. The first cam member may include a first at least partially curved engagement surface selectively movable relative to the first rotatable member. The second cam member may be operatively associated to the second rotatable member. The second cam member may include a second at least partially curved engagement surface selectively movable relative to the second rotatable member. The first foot engagement member may be operatively associated with the first cam member. The second foot engagement member may be operatively associated with the second cam member.

The first link member may extend from the first swing member to the first cam member. The first link member may be pivotally associated with the first cam member at a first location between the ends of the first engagement surface and may be operatively associated with the first swing member. A second link member may extend from the first swing member to the first cam member. The second link member may be pivotally associated with the first cam member at a second location between the ends of the first engagement surface and may be operatively associated with the first swing member.

The third link member may extend from the second swing member to the second cam member. The third link member may be pivotally associated with the second cam member at a third location between the ends of the second engagement surface and maybe operatively associated with the second swing member. The fourth link member may extend from the second swing member to the second cam member. The fourth link member may be pivotally associated with the second cam member at a fourth location between the ends of the second engagement surface and operatively associated with the second swing member.

A user may move the first foot engagement member in a first variable pathway and may move the second foot engagement member in a second variable pathway.

Another embodiment of an exercise machine may take the form of a striding exercise device including first and second rotatable members, first and second swing members, first and second cam members, first and second foot engagement members, and first, second, third and fourth link members.

The first cam member may be operatively associated with the first rotatable member. The first cam member may include a first at least partially curved engagement surface selectively movable relative to the first rotatable member. The first engagement surface may include first and second ends. The first end of the first engagement surface may be closer to the first swing member than the second end of the first engagement surface. The second cam member may be operatively associated to the second rotatable member. The second cam member may include a second at least partially curved engagement surface selectively movable relative to the second rotatable member. The second engagement surface may include first and second ends. The first end of the second engagement surface maybe closer to the second swing member than the second end of the second engagement surface.

The first foot engagement member may be operatively associated with the first cam member. The second foot engagement member may be operatively associated with the second cam member. The first link member may extend from the first swing member to the first cam member. The first link member may be pivotally associated with the first cam member at a first location farther from the first swing member than the first end of the first engagement surface and may be operatively associated with the first swing member. The second link member may extend from the first swing member to the first cam member. The second link member pivotally associated with the first cam member at a second location farther from the first swing member than the first end of the first engagement surface and may be operatively associated with the first swing member.

The third link member may extend from the second swing member to the second cam member. The third link member may be pivotally associated with the second cam member at a third location farther from the second swing member than the first end of the second engagement surface and may be operatively associated with the second swing member. The fourth link member may extend from the second swing member to the second cam member. The fourth link member may be pivotally associated with the second cam member at a fourth location farther from the second swing member than the first end of the second engagement surface and may be operatively associated with the second swing member.

A user may move the first foot engagement member in a first variable pathway and may move the second foot engagement member in a second variable pathway.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

DETAILED DESCRIPTION

Figure 1:
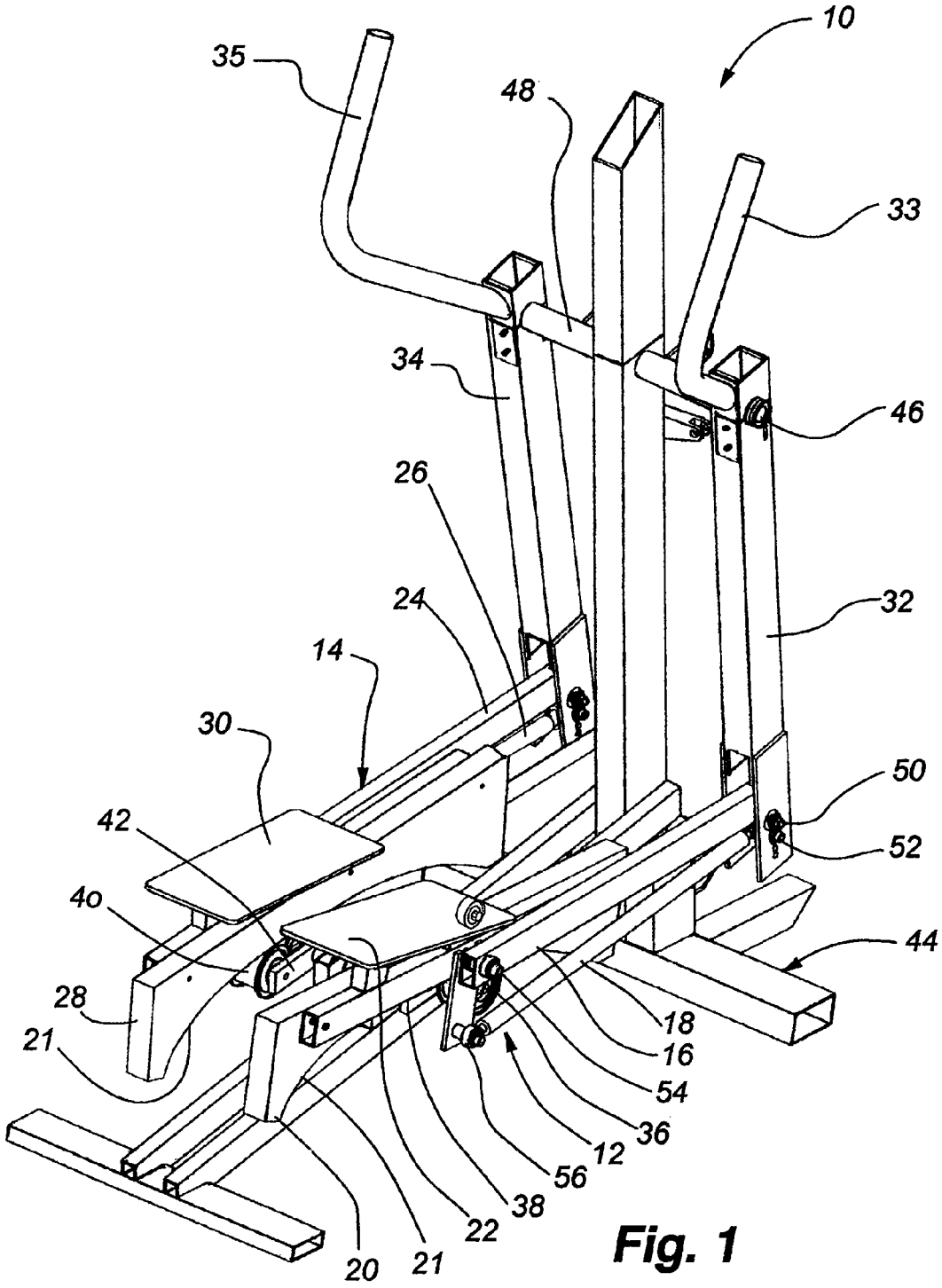
FIG. 1 depicts a perspective view of an exercise device.

Various embodiments of the exercise machine or device described herein enable lower body exercise or lower and upper body exercise while the user stands on the exercise apparatus and moves the user's legs and feet in a variety of elliptical and pseudo-elliptical striding paths. The various elliptical and pseudo-elliptical striding paths may simulate the motion of running, jogging, walking, and/or stepping in place, all referred to herein as "striding". These elliptical and pseudo-elliptical striding paths have both height (vertical) and length (horizontal) components of movement. As described in more detail below, a user may selectively vary the horizontal component of movement by varying the length of the user's stride. Certain embodiments of the exercise machine may include handles for a user to grip, some of which may be pushed and pulled by the user in synch with the striding motion.

An exercise machine conforming to aspects of the present invention may accommodate a variety of stride lengths of the user and allow the user to change the user's stride length while exercising without requiring the user to adjust the equipment's settings. The device allows for a user to vary his or her stride lengths throughout the exercise and in substantially real time adjusts the horizontal distance that a foot engagement member travels in response to the user changing his or her stride length. As used herein, the term "stride length" refers to the distance between rearward and forward end extents of travel of the user's foot during an exercise repetition. Thus, the exercise device allows the user to vary the stride length, thereby allowing the user to engage in a natural stride length, which can be varied during the exercise without being constrained to a particular stride length and height selected by the manufacturer, such as in conventional fixed path exercise devices.

The exercise apparatus described herein may include an improved construction and user feel over conventional elliptical machines, and greater flexibility and ease of operation.

The exercise apparatus may be comfortably used by users with different natural stride lengths. The device can simulate striding-type motions that vary from running with large stride lengths to stepping in place with little or no stride length. The movements of the device's foot engagement members can match the natural movements for users of various sizes. The exercise machine responds to the user's stride length input while the exercise is in progress.

Within this description, directions may be used to facilitate an understanding of the various exercise machines described herein. As used herein, "forward direction" means the direction traveled when moving generally horizontally in the direction that a user would face when using the exercise and "rearward direction" means the direction traveled when moving horizontally in the direction generally opposite the forward direction. "Upward direction" means the general direction traveled when moving vertically away from the base of, or support surface for, the exercise device, and "downward direction" means the general direction traveled when moving vertically towards the base of, or support surface for, the exercise device. As appropriate for the context, the forward and rearward directions may be understood to be a generally horizontal component of motion, and the upward and downward directions may be understood to be a generally vertical component of motion. It should be understood that the use of any directional terms, including terms such a "right", "left", "front", "rear", "upward", "downward" and so on, is intended solely to aid the reader in understanding the exercise machine and/or its operation and is not intended to be limiting in nature.

FIG. 1 depicts one embodiment of a variable stride exercise device 10, which may also be referred herein as a variable stride exercise machine, a variable stride exercise apparatus, or as an exercise device, machine or apparatus. The exercise device 10 may include a right cam-link assembly 12, which may also be referred to as the first cam-link assembly, and a left cam-link assembly 14, which may also be referred to as the second cam-link assembly. The assemblies 12, 14 are laterally spaced apart. Each assembly 12, 14 is configured to work in conjunction with other components or members, as described in more detail below, to move an associated foot engagement member 22, through a striding path, which may be variable, when operated by a user. Using an interlink mechanism, the two assemblies 12, 14 may be configured to function in tandem in a forward/rearward direction. Alternatively, each assembly 12, 14 may be configured to move independent of the other assembly 12, 14 in the forward/rearward direction by omitting, or selectively making inoperative, the interlink mechanism, or by otherwise not linking the assemblies 12, 14 for coordinated movement in the forward/rearward direction.

Figure 7:
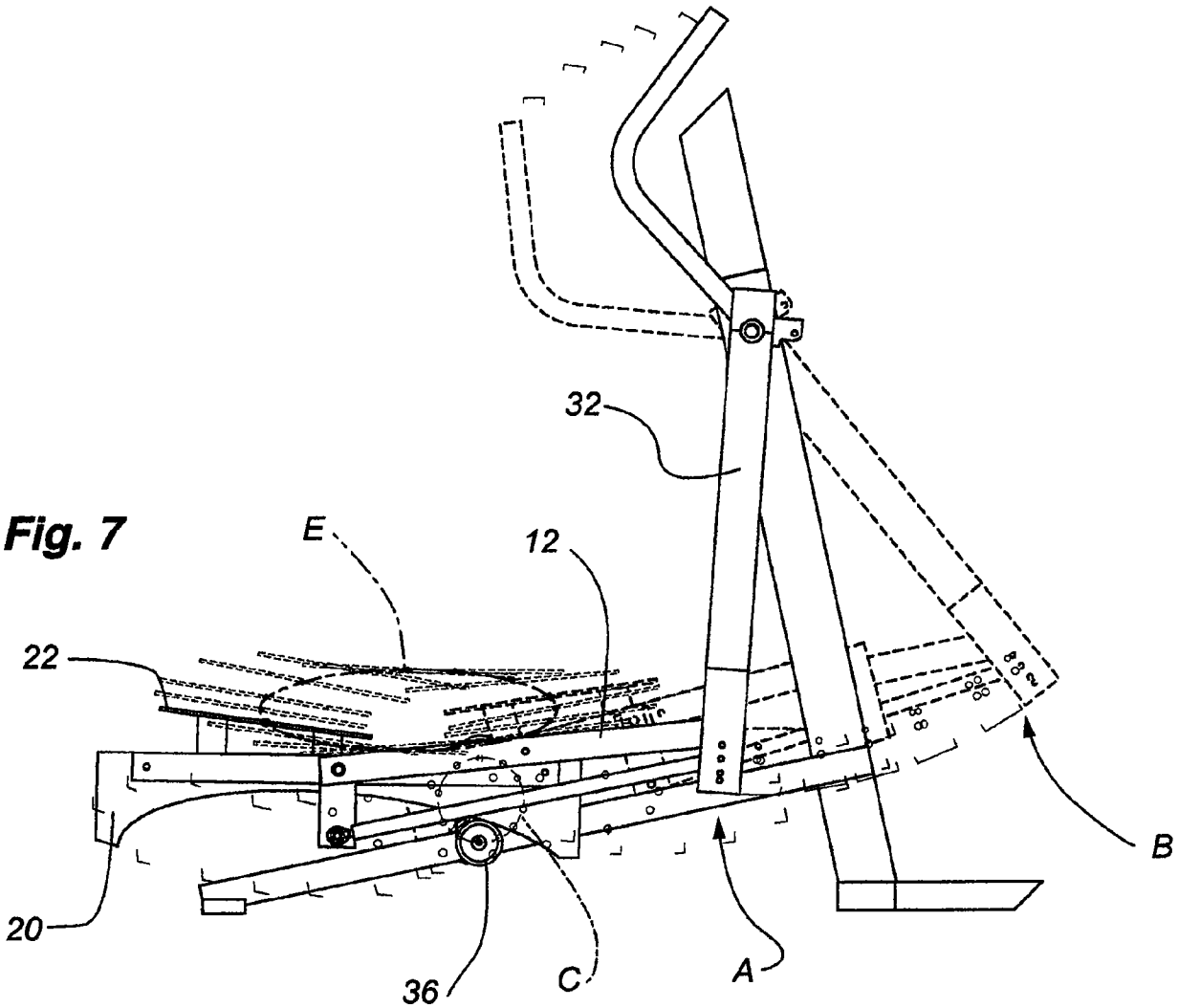
FIG. 7 depicts yet another side view of an exercise device shown in FIG. 1, showing an elliptical-like path E of a foot engagement member.

The right cam-link assembly 12 may include a right first link 16 (also referred to herein as a "beam" or "arm"), a right second link 18 (also referred to herein as a "beam" or "arm"), and a right cam member 20. The right-cam link assembly 12 may be operatively associated with a right foot engagement member 22. Similarly, the left cam-link assembly 14 may include a left first link 24, a left second link 26, and a left cam member 28. The left-cam link assembly 14 may be operatively associated with a left foot engagement member 30. As shown in FIG. 1, the cam-link assemblies 12, 14 according to one embodiment are generally supported at the right and left cam members 20, 28 by right and left rollers 36, 40, respectively. The rollers 36, 40, in turn, may be supported by right and left crank arms 38, 42, respectively. The right and left crank arms 38, 42 may be operatively coupled with a support frame 44 for rotation around a common rotation axis. In some embodiments, the right and left crank arms 38, 42 may each rotate around separate rotation axes. In other words, each crank arm 38, 42 may rotate around an axis that is not common the axis that the other crank arm rotates around. Rotating the crank arms 38, 42, and the resulting circular path of the rollers 36, 40, causes the left and right cam members 20, 28 to move up and down. For example, FIG. 7 depicts the circular path C of the right roller 36 that causes the right cam member 20 to move up and down along the path C.

Returning to FIG. 1, the right cam-link assembly 12 is operably coupled at the right first link 16 to a right swing link 32 and, as discussed above, further is operably coupled at the right cam member 20 to the right roller 36 on the right crank arm 38. Similarly, the left cam-link assembly 14 is operably coupled at the left first link 24 to a left swing link 34 and, as discussed above, further is operably coupled at the left cam member 28 to the left roller 40 on the left crank arm 42. The upper portions of each of the right and left swing links 32, 34 are operably coupled to the frame 44 at pivotal connections 45, 46 via pivot axle 48. The right and left swing links 32, 34 may include right and left handles 33, 35 that can be gripped by the user during use. The right and left handles 33, 35 may be fixedly or removably attached to right and left swing links 32, 34. Further, the right and left handles 33, 35 may be operably attached to their respective swing link 32, 34 for selective movement (e.g., pivoted or slid) relative to their respective swing link 32, 34. Movably attaching the right and left handles 33, 35 to the swing links 32, 34 may permit a user to adjust the position of the handles 33, 35 relative to the swing links 32, 34 and/or to move the handles 33, 35 in a direction that is independent of the direction moved by the swing links 32, 34 during an exercise.

The right and left cam members 20, 28 may each have downward facing generally arcuate or curved guide surfaces 21 that rest atop the right and left rollers 36, 40, respectively. The guide surface 21 of the right cam member 20 can also be seen in FIG. 1B. The guide surface 21 provides an engagement surface along which the rollers 36, 40 may roll during use of the machine. As set forth in greater detail below, when some forward or rearward force is applied to a foot engagement member 22, 30 by a user, the guide surface 21 associated with the foot engagement member will move forward or rearward on its respective roller 36, 40.

The guide surfaces 21 of each cam member 20, 28 may, or may not, have a single radius of curvature along the length of the guide surface 21. Further, the guides surface may, or may not, be symmetrical about the center point of the guide surfaces. In other words, the shape of a guide surface may differ, or may be the same, when moving along the engagement surface of the guide surface from the center point to each end of the guide surface. Yet further, the guide surfaces 21 may include convexly or concavely shaped curved portions, straight portions, points of inflection to transition from convex, concave or straight portions, and so on.

Figure 1A:
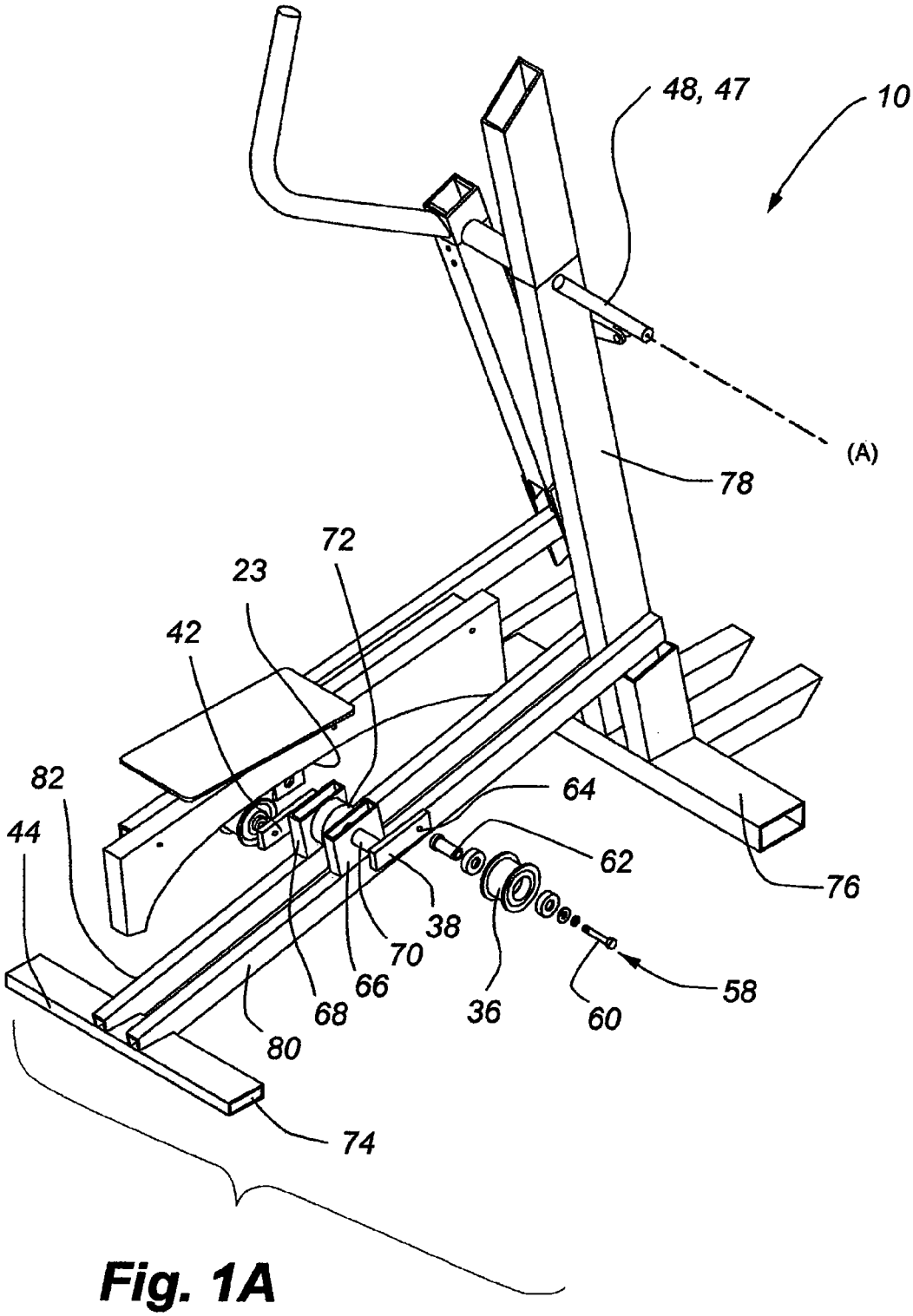
FIG. 1A depicts another perspective view of the exercise device shown in FIG. 1 with the right swing link and right cam-link assembly not shown to better show the right crank assembly, which is partially exploded.
Figure 6:
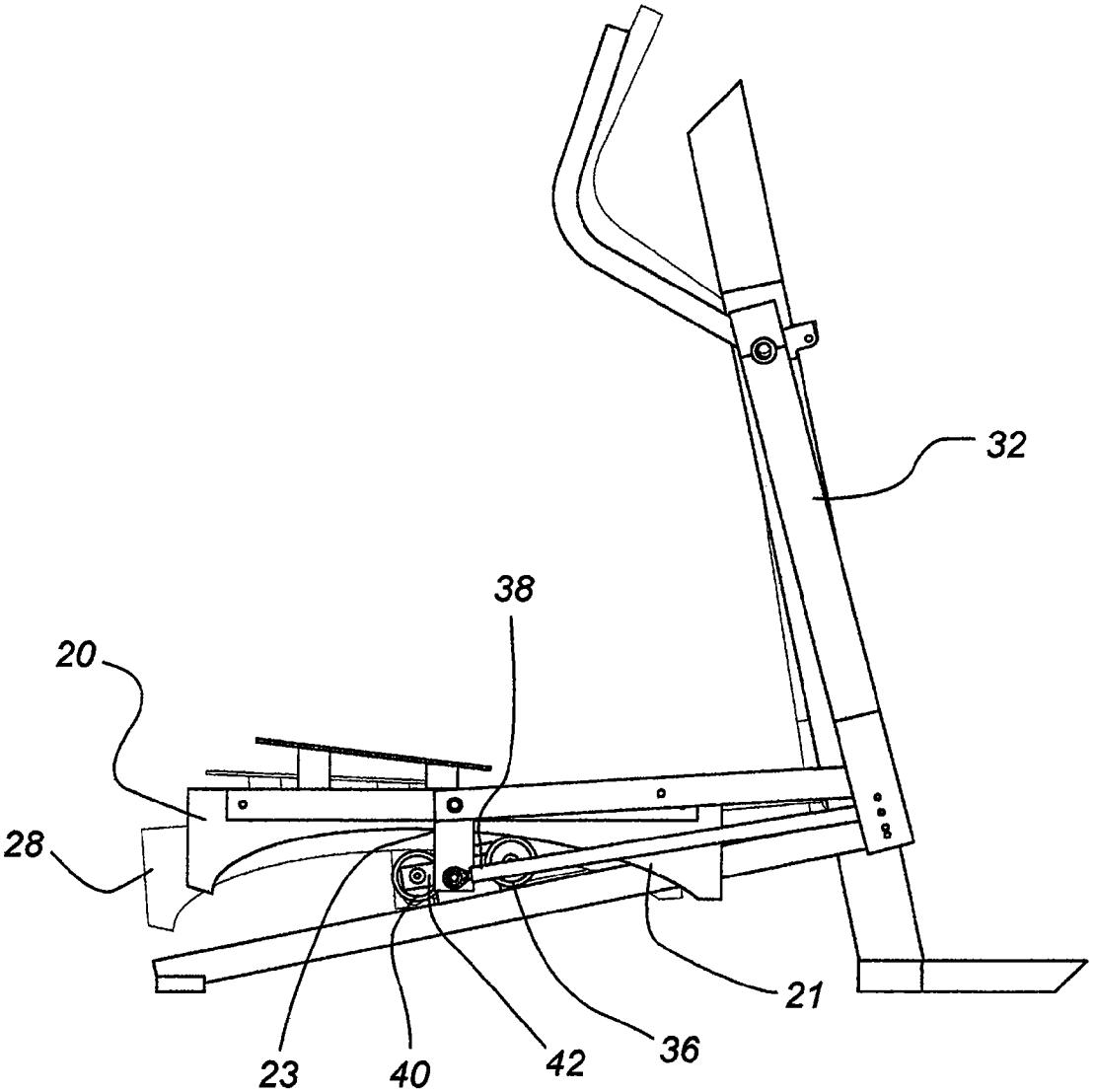
FIG. 6 depicts another side view of the exercise device shown in FIG. 1 showing the crank arms in a substantially horizontal position.

In some embodiments, the guide surfaces 21 of the right and left cam members 20, 28 may have peaked central portions 23, as best shown in FIGS. 1A and 6. The right and left rollers 36, 40 of the right and left crank arms 38, 42, respectively, may be shaped to laterally retain their respective right and left cam members 20, 28 thereon as the right and left cam members 20, 28, and thus the right and left foot engagement members 22, 30, reciprocally move freely in rearward and forward directions relative to their respective right and left rollers 36, 40 during use of the exercise device 10. This arrangement allows the user to change the stride length of the right and left foot engagement members 22, 30 (i.e., the horizontal distance traveled by the right and left foot engagement members 22, 30) by changing the user's stride length without requiring any machine adjustments while the exercise is in progress. The right and left rollers 36, 40 thereby allow rearward-forward movement of the right and left cam members 20, 28 relative to their respective right and left crank arms 38, 42 as the crank arms 38, 42 rotate and move the right and left cam members 20, 28 up and down. This combination of rearward-forward and up-down movement is best shown in FIG. 7 and results in the elliptical-like path E of the right and left foot engagement members 22, 30.

Although the right and left rollers 36, 40 are described and shown as engaging guide surfaces 21 of the right and left cam members 20, 28 to allow the right and left cam members 20, 28 to move relative to the right and left crank arms 38, 42, any structure or system that allows the right and left cam members 20, 28 to move in a forward and backward direction relative to the right and left crank arm 38, 42 may be used. For example, a rail and track system could be used in place of the roller and guide surface system to allow the right and left cam members 20, 28 to slid or otherwise move relative to the cranks arms 38, 42. As yet another example, one or more of the left and right rollers 36, 40 may be replaced with sliders or other structures that allow for relative movement between engaged surfaces. The foregoing examples are merely illustrative and are not intend to limitation the structures or methods used to allow the cam members 20, 28 to move relative to the cranks arms 38, 42.

While much of the following detailed description of the structure and function of the exercise device 10 will focus on the right-side components and be depicted from the right side, it is understood that the left-side components are essentially mirror images of the right-side components both structurally and operationally.

Focusing on the right cam-link assembly 12 and right swing link 32 as depicted in FIG. 1, the right first link 16 is pivotally connected to the right swing link 32 at first upper pivotal connection 50 and further is pivotally connected to the right cam member 20 at second upper pivotal connection 54. The right second link 18 is pivotally connected to the right swing link 32 at first lower pivotal connection 52 and further is pivotally connected to the right cam member 20 at second lower pivotal connection 56. Although the right first and second links 16, 18 are shown as connected to the right swing link 32, the right first and second links 16, 18 could be connected to any structure or system, which may or may not be attached to the frame 44, that constrain the end portions of the right first and second links 16, 18 distal the right cam member 20 to move within a predefined path. For example, the right first and second links 16, 18 could be joined to a rocker arm or the like. As yet another example, the right first and second links 16, 18 could be operatively connected to one or more rails, which could be straight or curved, flat or inclined. The foregoing examples are merely illustrative and not intended to limit connection of the first and second links 16, 18 to any particular structure or system.

Turning back to FIG. 1, the first lower pivotal connection 52 is spaced from and below first upper pivotal connection 50. Likewise, the second lower pivotal connection 56 is spaced from and below second upper pivotal connection 54. The second upper and lower pivotal connections 54, 56 may be located between the ends of the guide surface 21. In one such configuration, the upper and lower pivotal connections 54, 56 may be located proximate the right foot engagement member 22 when the forward end of the right foot engagement members does not extend in front of the front end of the guide surface 21, as shown, for example, in FIGS. 1, 1A and 1B. Although shown as located near the forward end of the right foot engagement member 22, the second upper and lower pivotal connections 54, 56 may be located at any location proximate the right foot engagement member 22 in such a configuration. Further, the second upper and lower pivotal connections 54, 56 may be located at any position relative to the right cam member 22, either between or not between the guide surface 21 as desired.

Locating of the second upper and lower pivotal connections 54, 56 as described in the foregoing paragraph between the ends of the guide surface 21 may be desirable because it allows for controlling the relative angle of the foot engagement members 22, 30, as defined from the rear to the front of the foot engagement members 22, 30, during movement of these members 22, 40 with the respective first and second links 16, 18, 24, 26. Further, when the front ends of the right and left foot engagement members 22, 30 do not extend beyond the front end of the guide surface 21 of their respective cam members 20, 28 and the second upper and lower pivotal connections 54, 56 are proximate their respective foot engagement members 22, 30, even greater control of the angle foot engagement members 22, 30 using their respective first and second links 16, 18, 24, 26 may be achievable. The capability of the first and second links 16, 18, 24, 26 to control the angle of their respective foot engagement members 22, 30 is described in more detail below.

Turning to FIG. 1A, which depicts the right and left rollers 36, 40, right and left crank arms 38, 42, and the left cam-link assembly 14, the right roller 36 and right crank arm 38 may be configured as follows. The right roller 36 is rotatably coupled to the right crank arm 38 via a rotatable roller connection 58. In one implementation, the rotatable connection 58 may take the form of an axle pin 60 supported on the right crank arm 38. The right roller 36 may be rotatably supported on the right crank arm 38 by a collar 62 or any known component capable of rotatably supporting the right roller 36. Alternatively, the right roller 36 can be rotatably coupled to the right crank arm 38 using any known rotational coupling arrangement.

The right crank arm 38 may be rotatably coupled to right and left crank arm suspension components 66, 68 via a crank arm axle 70 that is disposed through the suspension components 66, 68, which are mounted on the frame 44. The crank arm axle 70 may be rotatably supported in a fixed location on the right and left crank arm suspension components 66, 68 for rotation about a rotation axis generally transverse to the longitudinal frame members by a rotary bearing or bushing 72 secured to each of the suspension components 66, 68. Alternatively, the right and left crank arms 38, 42 are rotatably supported on the frame 44 by any known fashion by any known components.

The crank arm axle 70 may be positioned through the suspension components 66, 68 such that one end is positioned on the right side of the right crank arm suspension component 66 and coupled to the right crank arm 38, and the other end is positioned on the left side of the left crank arm suspension component 68 and coupled to the left crank arm 42. The right crank arm 38 and the left crank arm 42 may be attached to opposite end portions of the crank arm axle 70 to travel along repeating circular paths that are 180 degrees out of phase with one another. That is, as viewed from the right side of the exercise device 10, one crank arm is always positioned 180 degrees from the other with respect to the circular path that both crank arms 38, 42 take. The crank arms 38, 42 may be mounted to the frame 44 in any known manner. Further, although the crank arms 38, 42 are shown and depicted as oriented 180 degrees out of phase, the cranks 38, 42 could be positioned to be in phase or positioned at any relative angle between them as desired.

With continued reference to FIG. 1A, the frame 44 may include a rear base component 74, a front base component 76, an upright component 78, and right and left lateral support components 80, 82. The right and left lateral supports components 80, 82 may each be connected near or at one end to the rear base component 74 and near or at the other end to the front base component 76 and upright component 78. The right and left crank arm suspension components 66, 68 may be connected to and supported by the right and left lateral support components 80, 82, respectively. The swing arm pivot axle 48 and specifically, the inner stationary member 47 as shown in FIG. 1A (and FIG. 5), may be disposed through and connected to an upper portion of the upright component 78. As discussed above and in further detail below, the swing arm pivot axle may be operably and pivotally connected to the right and left swing links 32, 34. The swing links 32, 34 may be pivotally associated with the frame 44 in any known manner.

Figure 1B:
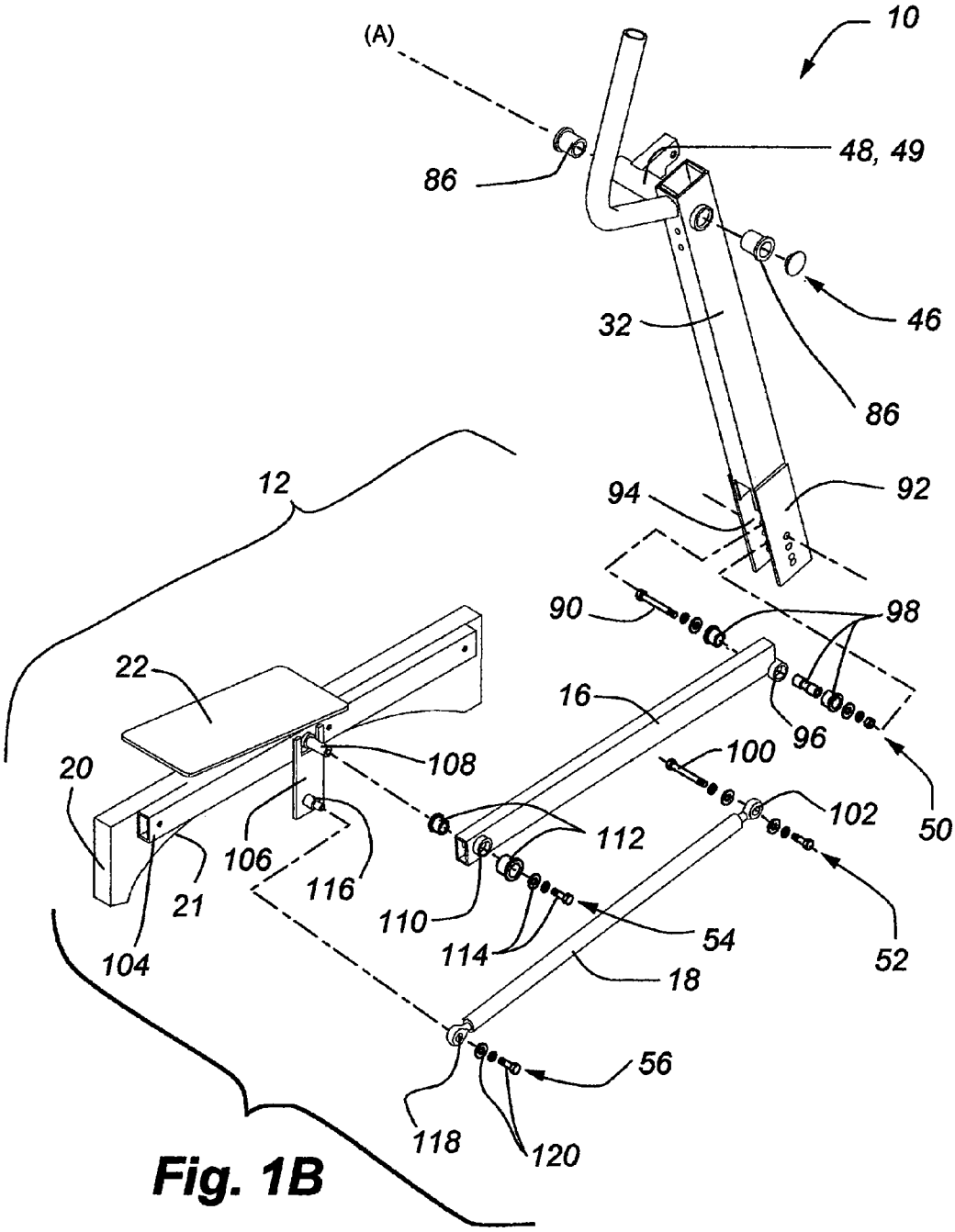
FIG. 1B depicts a partially exploded perspective view of a cam-link assembly and swing link of the exercise device shown in FIG. 1.
Figure 5:
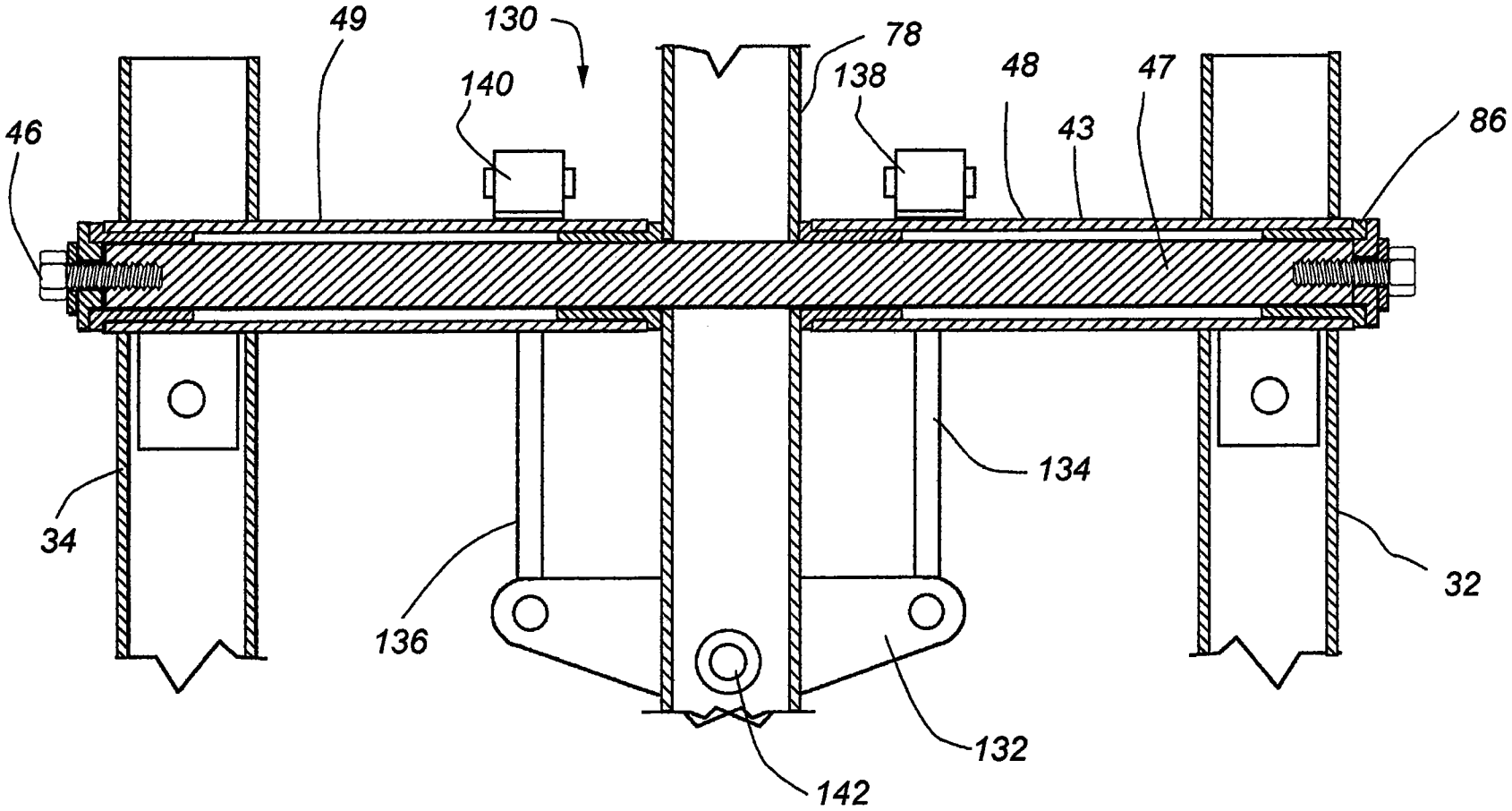
FIG. 5 depicts a partial rear cross-section view of the exercise device shown in FIG. 1, viewed along line 5-5 in FIG. 2.

The right cam-link assembly 12 and right swing link 32 are depicted in further detail in FIG. 1B. The swing link pivotal connection 46 between the right swing link 32 and the upright member 78 may take the form of a connection to swing link pivot axle 48. With reference to FIG. 5, the swing link pivot axle 48 may include a right outer rotatable portion 43 that is disposed over the inner stationary portion 47. The right outer rotatable portion 43 may be coupled to the inner stationary portion 47 by bushings or collars 86. Alternatively, the swing link pivotal connection 46 can be formed using any known component for providing a pivotal connection.

Returning to FIG. 1B, the first upper pivotal connection 50 that pivotally couples the right first link 16 to the right swing link 32 can include an upper link pivot pin 90 pivotally disposed through holes in the right and left bracket members 92, 94 of the upright member 32 and further through the hole 96 in the right first link 16. The upper link pivot pin 90 may be further pivotally disposed within bushings or collars 98. Alternatively, the first upper pivotal connection 50 can be formed using any known components for providing a pivotal connection.

Similarly, the first lower pivotal connection 52 between the right second link 18 and the right swing link 32 can include a lower link pivot pin 100 pivotally disposed through holes in the right and left bracket members 92, 94 and further through the hole 102 in the right second link 18. Alternatively, the first lower pivotal connection 52 can be formed using any known components for providing a pivotal connection.

Similarly, the second upper pivotal connection 54 between the right first link 16 and the right cam member 20 is also depicted in FIG. 1B. The right cam member 20 may include a connection bar 104 positioned along the right side of the right cam member 20. Alternatively, the connection bar 104 may be omitted, if desired. A connection plate 106 may be connected to and extended downwardly from the connection bar 104. The second upper pivotal connection 54 between the right first link 16 and the connection plate 106 may include a second upper link pivot pin 108 pivotally disposed through a second hole 110 in the right first link 16. The second upper pivot pin 108 may be further pivotally disposed within bushings or collars 112 which are secured to the second upper link pivot pin 108, along with the right first link 16, by a bolt and washer 114 or similar known securement component. Alternatively, the second upper pivotal connection 54 can be formed using any known components for providing a pivotal connection.

In addition, the second lower pivotal connection 56 between the right second link 18 and the connection plate 106 can include a second lower link pivot pin 116 pivotally disposed through a second hole 118 in the right second link 18. According to aspects of the invention, the right second link 18 may be secured to the second lower link pivot pin 116 by a bolt and washer 120 or similar known securement component. Alternatively, the second lower pivotal connection 54 can be formed using any known components for providing a pivotal connection. The connection plate 106, right cam member 20, right engagement member 22, and connection bar 104 may, in this embodiment, all be attached together to move as one unit by any suitable connection method, including, but not limited to, using mechanical fasteners, welds, or adhesives. In some embodiments, two or more of the connection plate 106, right cam member 20, right engagement member 22, and connection bar 104 may be integrally formed with each other by any known method, including, but not limited to, by casting, injection molding, and so on.

Figure 2:
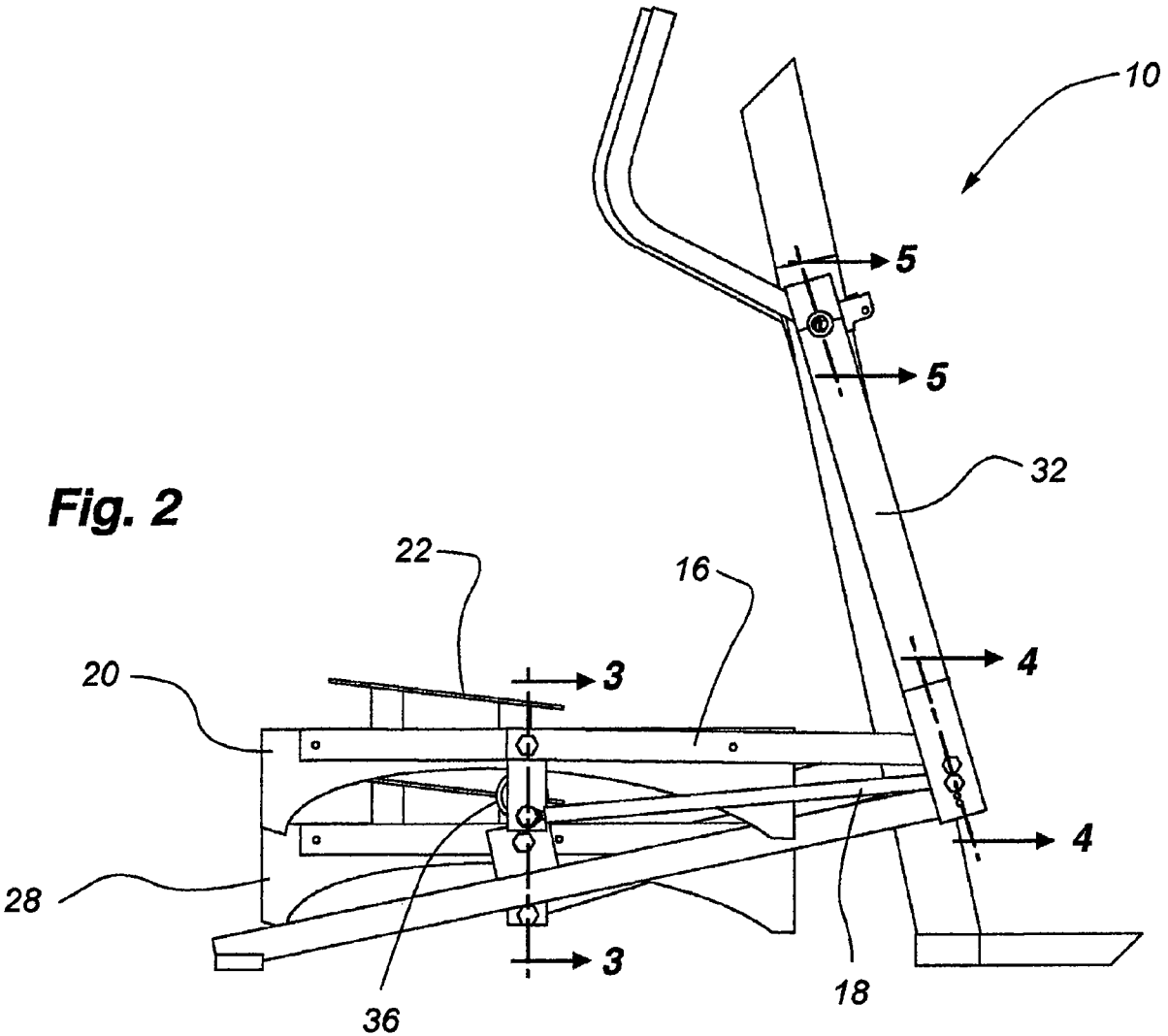
FIG. 2 depicts a side view of the exercise device shown in FIG. 1.

FIG. 2 depicts another view of the exercise device 10 depicted in FIG. 1. In this configuration, the crank arms 38, 42 (not visible) are positioned such that the right crank arm 38 and right roller 36 are at the peak or uppermost position of their rotational paths, and thus left crank arm 42 and left roller 40 are at the lowest position of their rotational paths. Further, the right and left swing links 32, 34 are disposed similarly such that neither is in a forward position with respect to the other.

Figure 3:
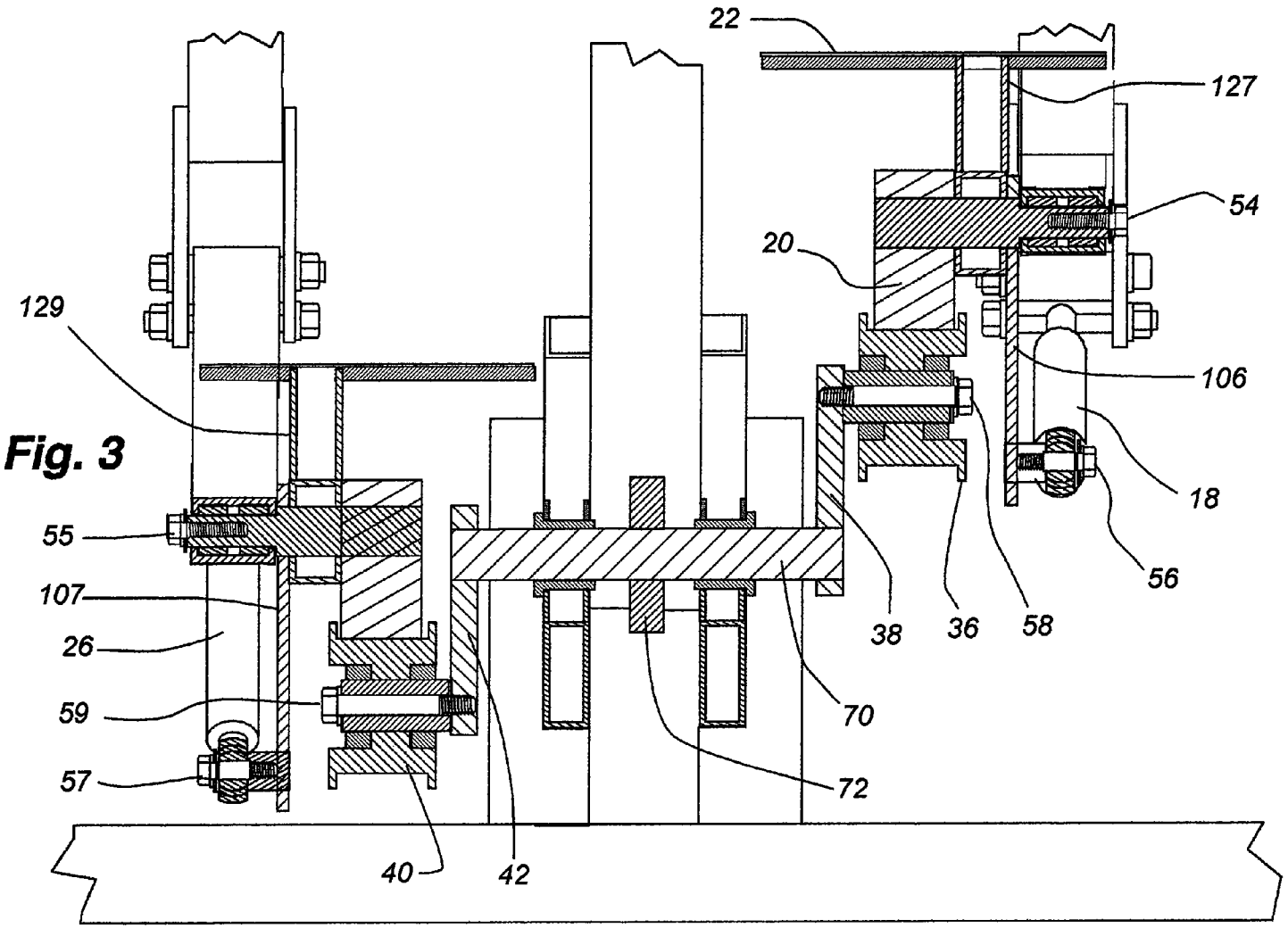
FIG. 3 depicts a partial rear cross-section view of the exercise device shown in FIG. 1, viewed along line 3-3 in FIG. 2.

FIG. 3 is a partial rear cross-section view of the exercise device 10 taken along line 3-3 in FIG. 2, with the right crank arm 38 and roller 36 positioned at its uppermost position, and the left crank arm 42 and roller 40 positioned at its lowest position. FIG. 3 also shows the various pivotal connections of the exercise device 10, including the left-side second upper pivotal, second lower pivotal, and rotatable connections 55, 57, and 59, which correspond to the right-side second upper pivotal, second lower pivotal and rotable connections 54, 56, and 58, respectively, which are described above. Left-side second upper pivotal connection 55 corresponds to right-side second upper pivotal connection 54 and pivotally connects the left first link 24 to connection plate 107. Left-side second lower pivotal connection 57 corresponds to the right-side second lower pivotal connection 56 and pivotally connects the left second link 26 to the connection plate 107. Left-side rotatable connection 59 corresponds to the right-side rotatable connection 58 and rotatably connects the left roller 40 to the left crank arm 42.

Foot engagement members 22 and 30 may be positioned above their respective cam member 20, 28 by risers 127, 129. Risers 127, 129 provide a height dimension, as well as an angled position for the foot engagement members 22, 30 relative to their respective cam member 20, 28. Risers may help fine tune or precisely control a user's foot position through the path of motion. Alternatively, the right and left foot engagement members 22, 30 may be mounted directly on their respective cam member 20, 28. In yet another alternative, the right and left foot engagement members 22, 30 may be mounted anywhere along the length of either their respective cam member 20, 28, or their respective first links 16, 24.

Figure 4:
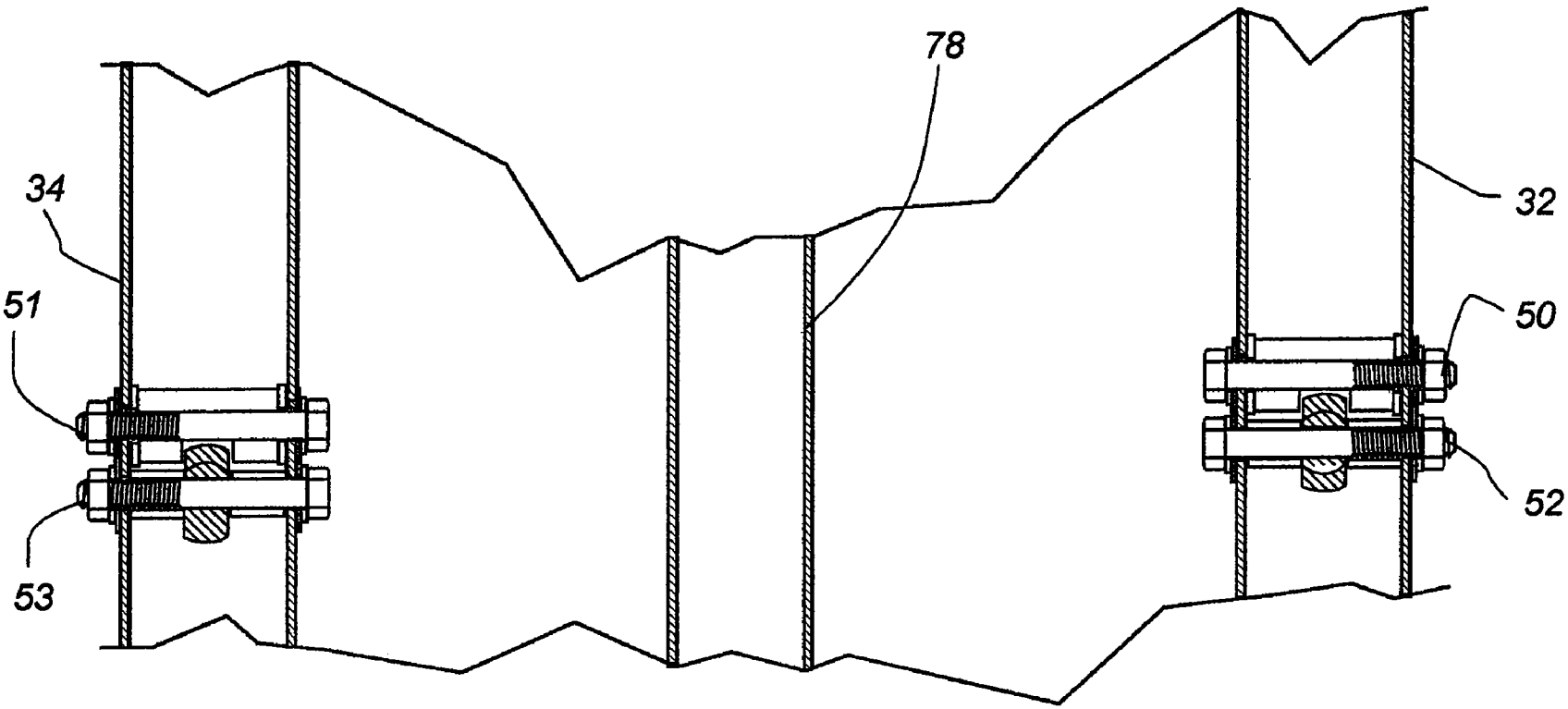
FIG. 4 depicts a partial rear cross-section view of the exercise device shown in FIG. 1, viewed along line 4-4 in FIG. 2.

FIG. 4 shows a partial rear cross-section view of the exercise device 10 taken along line 3-3 in FIG. 2. This figure depicts the right and left swing links 32, 34 and their pivotal connections, including the left-side first upper and lower pivotal connections 51 and 53, which correspond to the right-side upper and lower pivotal connections 50 and 52, respectively, which are described above. Left-side first upper pivotal connection 51 corresponds to right-side first upper pivotal connection 50 and pivotally connects the left first link 24 to the left swing link 34. Left-side first lower pivotal connection 53 corresponds to the right-side first pivotal connection 52 and pivotally connects the left second link 26 to the left swing link 34.

FIG. 5 shows a partial rear cross-section a partial rear cross-section view of the exercise device 10 taken along line 3-3 in FIG. 2. This figure shows an interconnection or dependency assembly 130 connected to the upright member 78 and the right and left outer rotatable portions 43, 49 of the swing link pivot axle 48. The interconnection assembly 130 may include a teeter member 132, a right interconnection link 134, a left interconnection link 136, a right U-bracket 138, and a left U-bracket 140. A teeter axle 142 extends through the upright member 78 and pivotally supports the teeter member 132. The left interconnection link 136 is pivotally connected with the teeter member 132 and extends upwardly therefrom to pivotally connect with the left U-bracket 140. The left U-bracket is connected with the left outer rotatable portion 49 of the pivot axle 48. The right interconnecting link 134 is pivotally connected with the teeter member 132 and extends upwardly therefrom to pivotally connect with the right U-bracket 138. The right U-bracket 138 is connected with the right outer rotatable portion 43 of the pivot axle 48.

This interconnection of the swing arms 32, 34 by the interconnection assembly 130 produces a dependency with respect to the rearward-forward swinging motion of the right and left swing arms 32, 34 during use. In other words, the rearward movement of the rearward moving cam-link assembly drives the other cam-link assembly forward without requiring any force applied by the user's foot that is engaged with the foot engagement member associated with the forward moving cam-link assembly or by the user's hand that may be engaged with the swing link associated with the forward moving cam-link assembly. More specifically, when the lower portions of either of the right or left swing links 32 or 34 are pulled rearward by the rearward movement of the swing link's associated cam-link assembly, the associated U-bracket 138 or 140 of the interconnection assembly 130 pivots upwardly.

For example, when the right swing link 32 rotates in a clockwise direction (as viewed from the right side of the exercise device), the right outer rotatable portion 43 of the pivot axle 48 also rotates in a clockwise direction around the inner stationary portion 47, thereby rotating the right U-bracket 138 such that the U-bracket 138 pulls (through the right interconnection link 134) the right portion of the teeter member 132 upwardly and causes the teeter to rotate counterclockwise around the teeter axle 142 (as viewed from the rear of the exercise device). As the teeter member rotates counterclockwise, the left portion of the teeter member 132 pulls downwardly on the left U-bracket 140 (through the left interconnection link 136), which in turn, causes the left swing link 34 to rotate about the about the upper pivot in a counterclockwise direction (as viewed from the right side of the exercise device). As the left swing link 34 rotates counterclockwise, its lower portion will move in a forward direction, which will pull its associated left cam-link assembly 14 in a forward direction. As the left cam-link assembly 14 is pulled in the forward direction, the left foot engagement member 30 will also move in a forward direction without requiring the user to exert a forward force on the left foot engagement member 30 and/or the left swing member 34. Similarly, when the lower portion of the left swing link 34 moves rearward, the interconnect mechanism will move the lower portion of the right swing link 32 in a forward direction.

Although the interconnect assembly 130 has been described above with specificity, any other interconnect or dependency structure or assembly may be utilized, such as a cable system or the like connecting the cam-link assemblies or the swing arms. Alternatively, the right and left swing links 32, 34 may be configured to operate independently of each other by omitting, or selectively disabling, the interconnection assembly 130.

The use of the exercise device 10 will now be discussed. More specifically, the operation of the exercise device 10 from the perspective of a user will be examined. FIGS. 6 and 7 depict schematic views of the operation of the exercise device 10. The exercise machine 10 is operated when the user's right and left feet are placed in operative contact with the foot engagement members 22, 30, respectively. The user exercises by striding forwardly toward the upright member 78. The operation of the exercise machine 10 can be started with the cam right and left members 20, 28 in any position. Each rearward striding motion of a user's foot, while engaging one of the right and left foot engagement members 22, 30, moves the right or left cam member 20, 28 corresponding with foot away (i.e. rearward) from the upright member 78. As the one cam member 20 or 28 is pushed rearward by the user, the other cam member 20 or 28 tends to be carried forward toward the upright member 78 by the combined force resulting from (1) the crank arm 38, 42 supporting the other cam member 20 or 28 applying a forward force on the cam member, (2) the swing arms 32, 34 supporting the cam-link assemblies 12, 14 tending to pull the cam-link assembly forward as it seeks a position hanging straight downward, and (3) the user's other foot applying a forward force on the cam-link assembly as it is moved forward in preparation for the next stride. However, the user naturally keeps enough weight on the forward moving cam-link assembly that the forward moving cam-link assembly will not be moved more or less forward than the user moves their forward moving foot on that cam-link assembly. Thus, the forward moving cam-link assembly moves forward with the foot thereon.

For example, with the exercise machine in the position illustrated in FIG. 6, the user's gravitational mass, i.e., weight, placed predominantly on the right foot engagement member 22 causes the right cam member 20 to sink downwardly. The force on the right cam member 20 is transmitted to the right crank arm 38 (to which right roller 36 is rotationally attached), thus causing the right crank arm 38 to rotate in the clockwise direction (as viewed from the right side of the exercise machine in FIG. 6) about the crank arm axle 70 as the right cam member 20 moves downwardly. A natural striding motion causes the user to initially ride the right foot engagement member 22 downward but to begin pushing rearwardly as the user's right foot moves further downward, much as the user would initially bring the foot into contact with the ground and then push against the ground while striding to move forward. This rearward pushing movement moves the right cam member 20 rearward. This, in turn, causes the left crank arm 42 to rotate clockwise (as viewed from the right side of the exercise machine) and move upward and then forward, thereby causing the left roller 40, and thus the left cam member 28, to move upward and then forward as the right cam member 20 moves rearward. The inertia of the rotation of the right and left crank arms 38, 42 in combination with the continued downward and rearward pushing of the user's right foot rotates the right crank arm 38 past its bottom dead center position (i.e., the 6 o'clock position), and thus rotates the left crank arm 42 clockwise past its top dead center position (i.e., the 12 o'clock position).

The variable stride capabilities according to certain aspects of various embodiments of the exercise device 10 are accomplished in the following manner. As the right crank arm 38 moves towards its bottom position and the left crank arm 42 moves towards its top position, the user will naturally stop pushing rearward on the right foot engagement member 22 with the user's right foot and will transfer his or her weight predominantly to the left foot. When this weight transfer occurs depends on the length of the user's stride. The longer the stride, the later the weight shift will occur after the right crank arm 38 passes the bottom dead center position and begins to rise.

Unlike conventional fixed stride elliptical exercise machines, which have fixed forward-rearward movement of the right and left foot engagement members precisely controlled by being fixedly attached to their crank arms, the right and left foot engagement members 22, 30 move with the user's feet substantially rearward and forward, respectively, and thus the right and left cam members 20 and 28 move rearward and forward relative to the right and left rollers 36, 40 of the right and left crank arms 38, 42, generally independent of the rotational position of the crank arms 38, 42. More specifically, the downward facing guide surface 21 of the right cam member 20 rollingly engages the right roller 36 may moves either forward or rearward in relation to the right roller 36 while the downward facing guide surface 21 of the left cam member 28 rollingly engages the left roller 40 and may move either forward or rearward in relation to the left roller 40.

Thus, the rearward pushing movement of the user's right foot on the right foot engagement member 22, and hence on the right cam member 20, for example, might be stopped even before the right crank arm 38 reaches the bottom dead center position for a short stride (for almost a stepping or jogging in place movement with very little forward-rearward travel of the foot links), or might be stopped after the right crank arm 38 is in a horizontal position pointing rearward but before reaching the top dead center position (for a long striding movement, especially for a user with long legs and a naturally long stride).

Accordingly, when the user stops pushing rearward with the right foot, the user's weight will be predominantly transferred to the left foot, and thus the left foot engagement member 30 and the left cam member 28. At this point, the left crank arm 42 will have been rotated clockwise from the lower position of the left crank arm 42 shown in FIG. 6 to an upper position. This might be at or about the top dead center position of the left crank arm 42 for a stepping or jogging in place movement with a very short (if any) forward-rearward travel of the cam members 20, 28, or near or after a horizontal position where the left crank arm 42 is pointing forward for a long striding movement, or anywhere the left crank arm 42 is located when the weight transfer occurs. The weight transfer to the left foot engagement member 30 and hence the left cam member 28 will normally occur for smooth operation when the left crank arm 42 is in a position where downward movement of the left cam member 28 is still possible under the user's weight after the weight transfer occurs.

Once the weight transfer occurs to the left cam member 28, the user continues the exercise movement, this time with the left foot moving downward and pushing rearward against the left foot engagement member 30, while the user simultaneously moves the user's right foot forward while the right foot engagement member 22 and the right cam member 20 move forward with it. As with the right foot, the natural striding movement of the left foot is to initially ride the left cam member 28 downward but to push rearwardly as the user's left foot moves farther downward. By the time the left crank arm 42 supporting the left foot engagement member 30 to which the user's weight is transferred nears the bottom dead center (6 o'clock) position, the user's left foot is applying an increasingly horizontal rearward pushing force to the left foot engagement member 30. As described for the right foot, the user will shift his or her weight back to the right foot engagement member 22 and a full cycle with both right and left foot forward strides will be completed. By continuing to cyclically move the right and left feet as described, a natural striding movement is achieved, which can have a very different stride length and path for each user and can be changed in response to the user changing his stride length during the exercise.

Figure 8B:
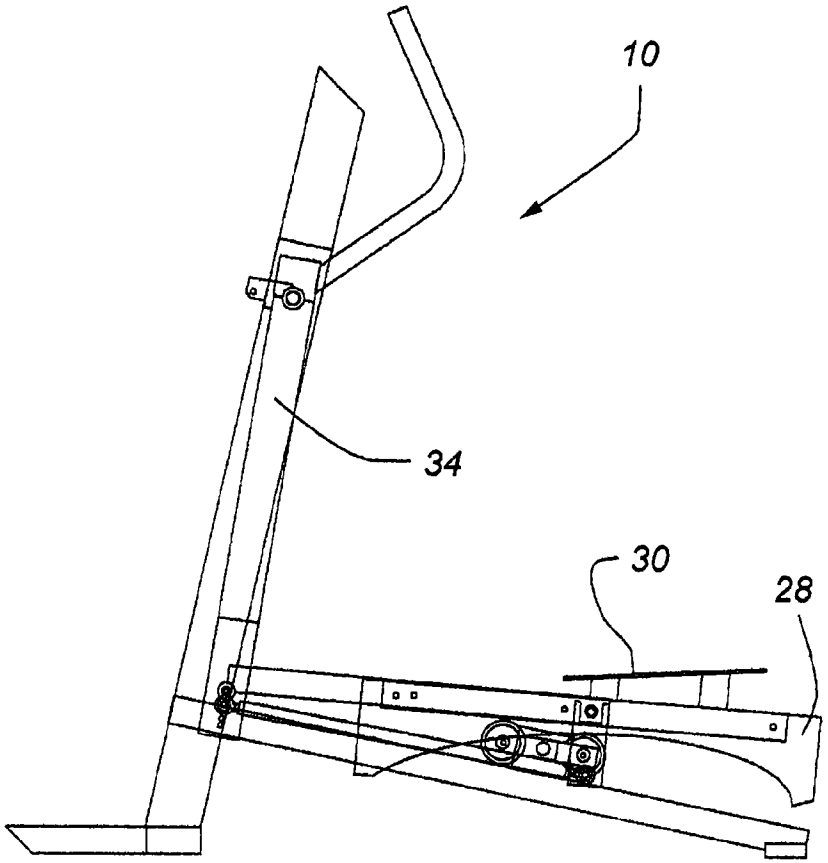
FIG. 8B depicts a schematic left side view of the exercise device shown in FIG. 8A, showing the position of the other cam-link assembly and associated crank arm and roller.
Figure 8A:
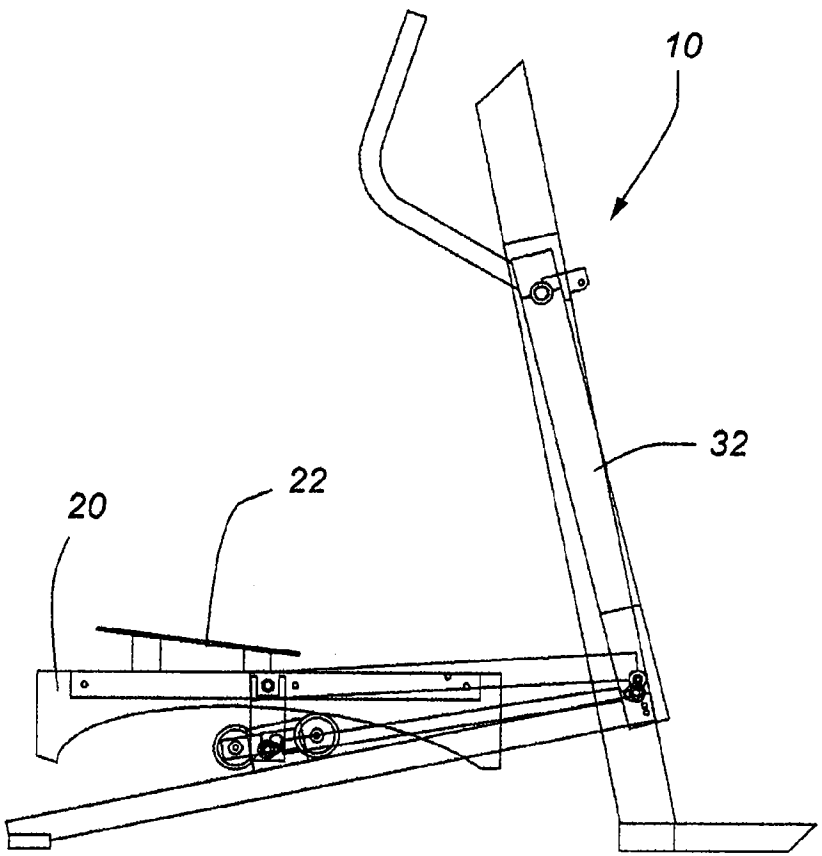
FIG. 8A depicts a schematic right side view of an exercise device similar to the exercise device shown in FIG. 1, showing the position of one cam-link assembly and associated crank arm and roller.
Figure 9B:
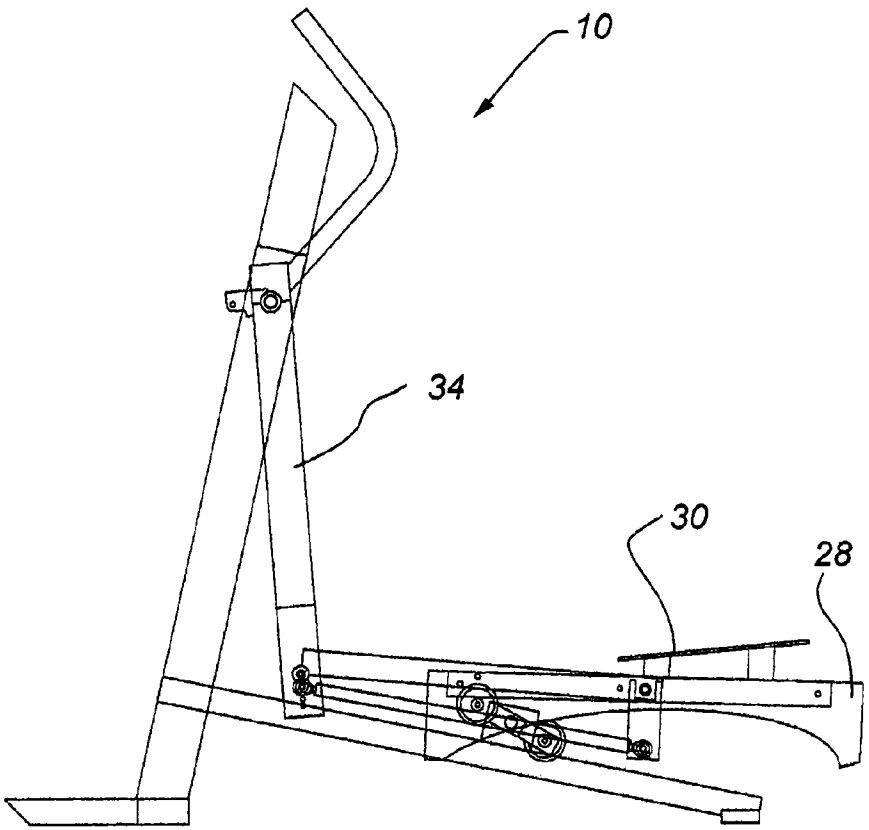
FIG. 9B depicts a schematic left side view of the exercise device shown in FIG. 9A, showing the position of the other cam-link assembly and associated crank arm and roller.
Figure 9A:
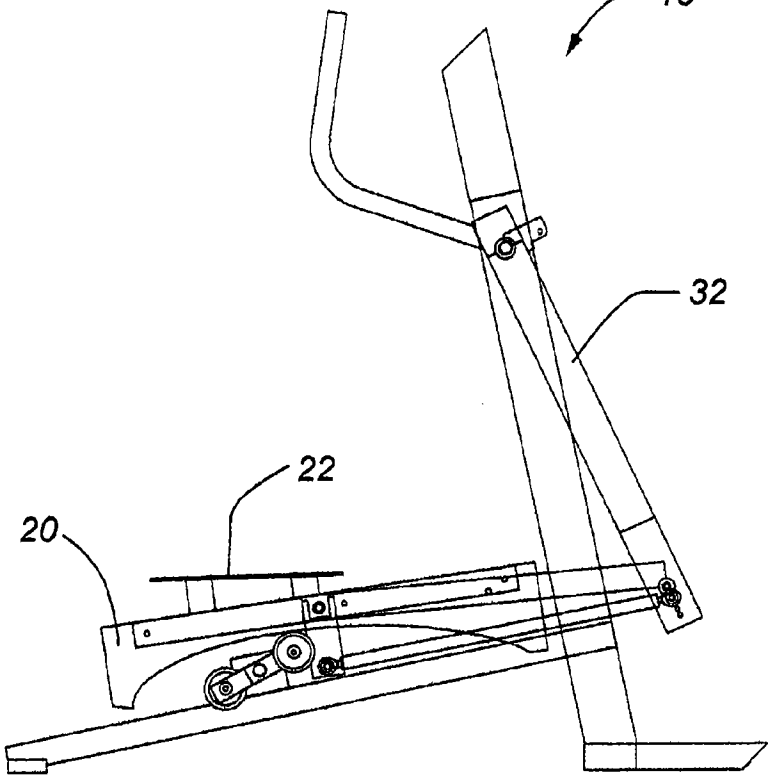
FIG. 9A depicts a schematic right side view of an exercise device similar to the exercise device shown in FIG. 1, showing the position of one cam-link assembly and associated crank arm and roller.
Figure 10B:
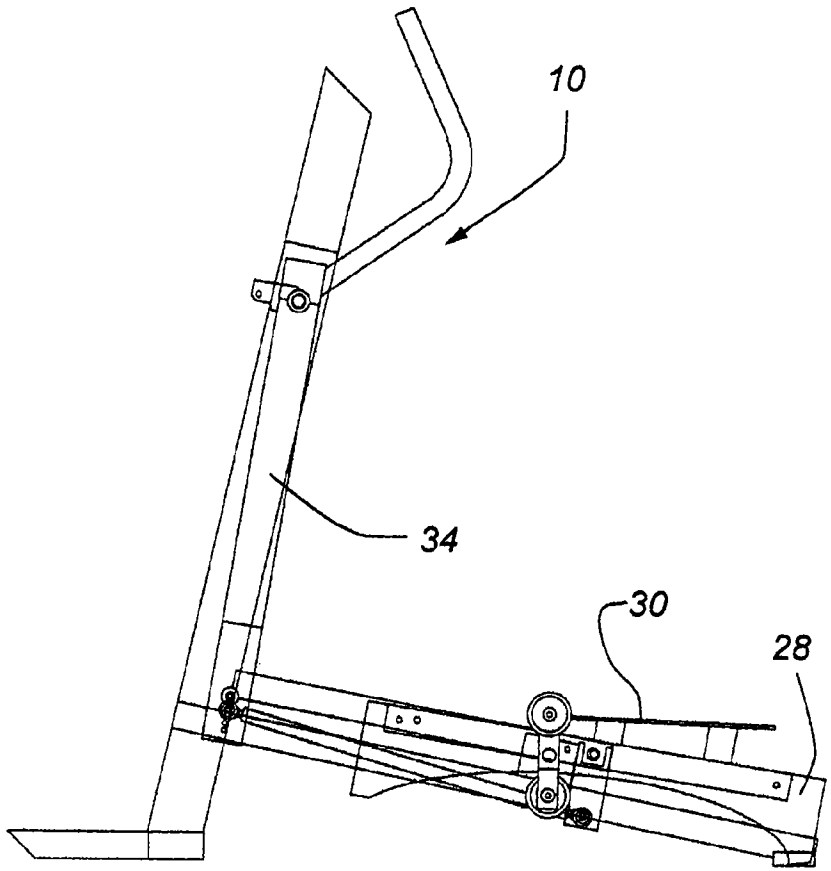
FIG. 10B depicts a schematic left side view of the exercise device shown in FIG. 10A, showing the position of the other cam-link assembly and associated crank arm and roller.
Figure 10A:
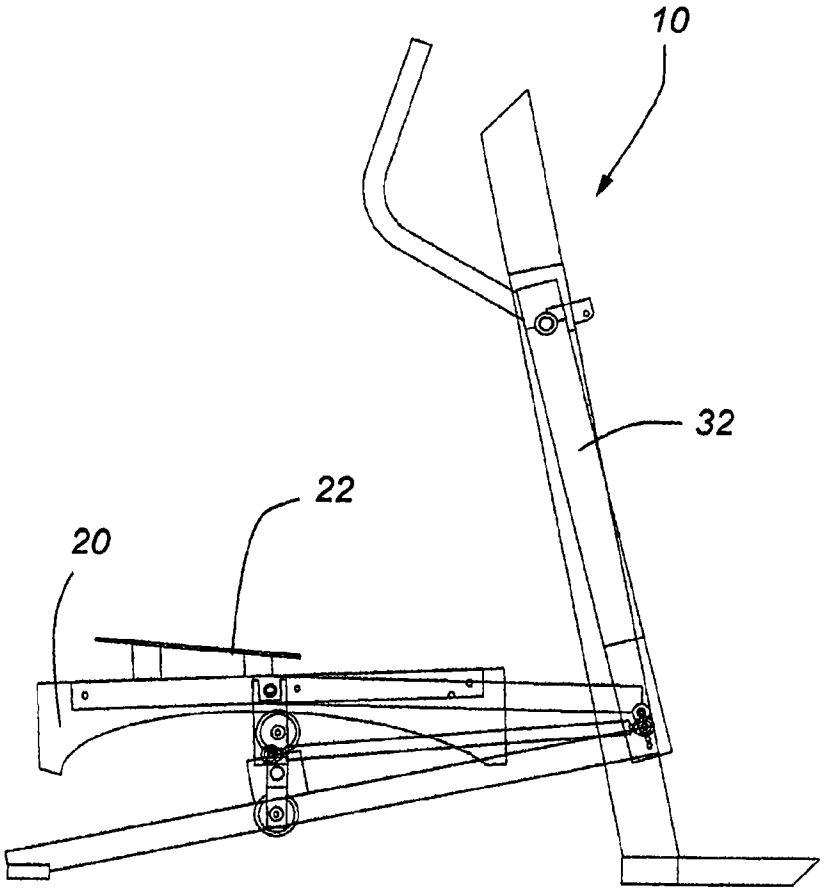
FIG. 10A depicts a schematic right side view of an exercise device similar to the exercise device shown in FIG. 1, showing the position of one cam-link assembly and associated crank arm and roller.
Figure 11B:
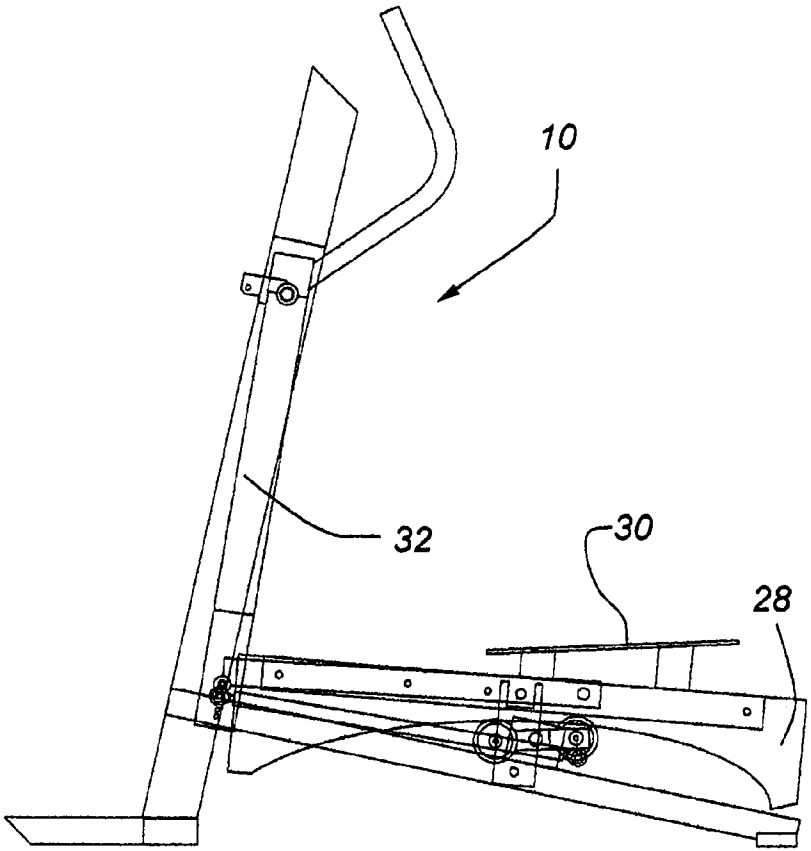
FIG. 11B depicts a schematic left side view of the exercise device shown in FIG. 11A, showing the position of the other cam-link assembly and associated crank arm and roller.
Figure 11A:
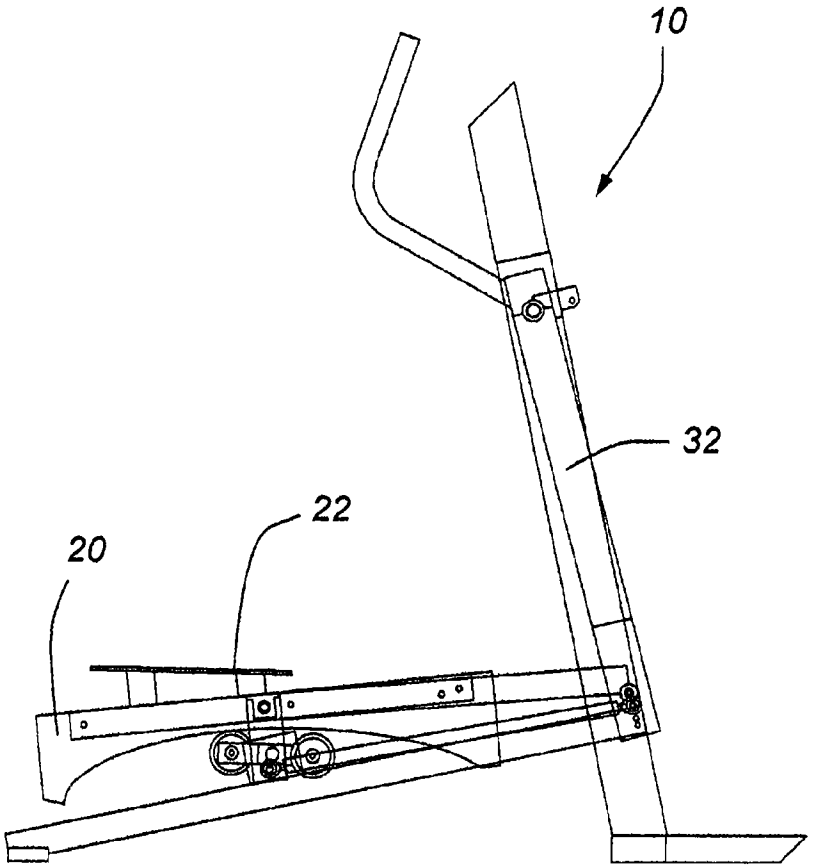
FIG. 11A depicts a schematic right side view of an exercise device similar to the exercise device shown in FIG. 1, showing the position of one cam-link assembly and associated crank arm and roller.
Figure 12A:
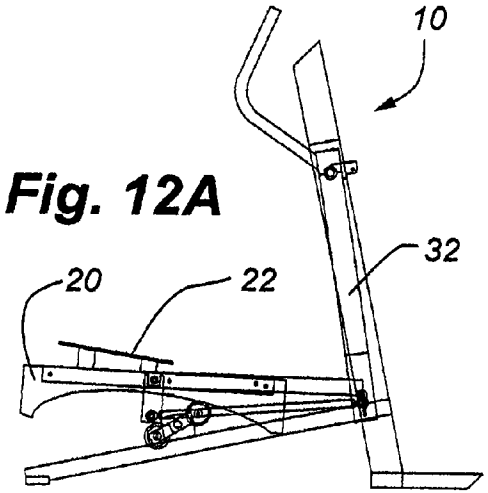
FIGS. 12A-F depicts side views of an exercise device similar to the one shown in FIG. 1 in various configurations of operation.
Figure 12B:
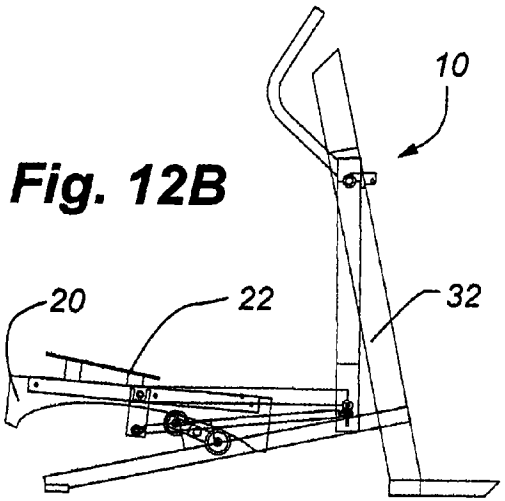
Figure 12C:
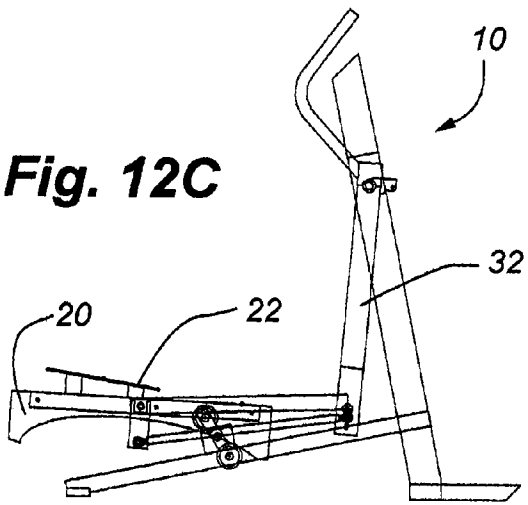
Figure 12D:
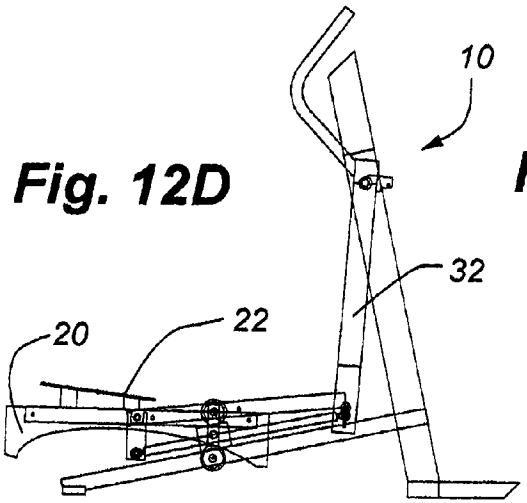
Figure 12E:
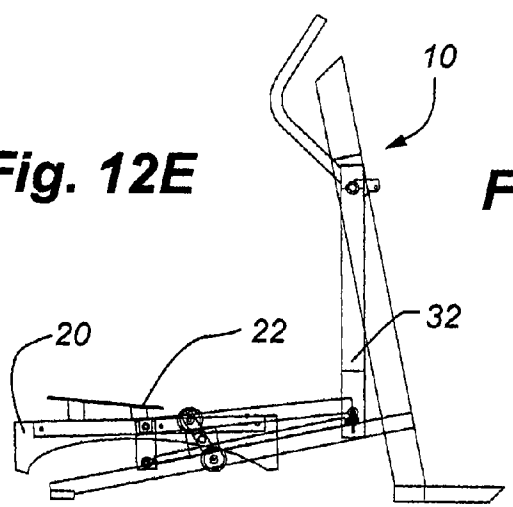
Figure 12F:
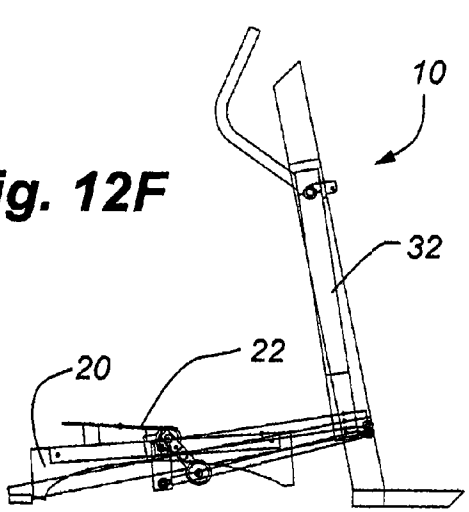

FIGS. 8A, 8B, 9A, 9B, 10A, 10B, 11A, 11B, and 12A-12F further depict schematic elevation views of exercise devices similar to the exercise device 10 shown in FIG. 1 with the cam-link assemblies and swing links positioned in various configurations as they could be during use. FIGS. 8A and 8B depict the same configuration, with FIG. 8A depicting the position of the right cam-link assembly and right swing link as viewed from the right side of the exercise device and FIG. 8B depicting the position of the left cam-link assembly and left swing link as viewed from the left side. Similarly, each pair of FIGS. 9A and B, 10A and B, and 11A and B depict the same configuration, with FIGS. 9A, 10A and 11A depicting the position of the right cam-link assembly and right swing link as viewed from the right side of the exercise device and FIGS. 9B, 10B and 11B depicting the position of the left cam-link assembly and left swing link as viewed from the left side. In addition, FIGS. 12A through 12F depict various configurations of the right cam-link assembly and swing link of the exercise device as viewed from the right side of the exercise device.

The variable stride capabilities of the exercise machine 10 distinguish it from conventional fixed stride elliptical devices. That is, in contrast to conventional fixed stride exercise devices, the exercise machine 10 provides a variable stride length that is dynamically user adjustable while an exercise is in progress without changing any machine settings, and without the machine changing its own settings, by the simple act of the user taking a longer or shorter stride (or stepping motion). Furthermore, the exercise machine 10 is very adjustable within the physical limitations of the exercise machine, and is therefore naturally variable to complement the different natural stride lengths of taller and shorter users, and even the different stride lengths of users with the same height, and even the different stride lengths a user wishes to use during the course of an exercise. The exercise machine 10 produces a elliptical or pseudo-elliptical stride path that may be relatively constant (user does not change stride length) or variable (user changes stride length) in response to the user input through the movement of the user's feet when performing an exercise.

For purposes of illustrating the construction and operation of the exercise machine 10, if the user evenly balanced the user's weight between the right and left foot engagement members 22 and 30, the right and left cam members 20, 28 could be held in a substantially parallel arrangement similar to that depicted in FIG. 6. In other words, the right and left crank arms 38 and 42, for example, could be positioned in the 3 o'clock and 9 o'clock positions, halfway between the top dead center and bottom dead center positions (i.e., the 6 o'clock and 12 o'clock positions). If the user's weight could remain so balanced between the foot engagement members 22, 30, a user's striding motion in the forward direction for one foot and the rearward direction with the other foot would move one of the right and left cam members 20, 28 rearward and the other forward since each cam member 20, 28 is rollingly supported by its respective roller 36, 40. The distance of the foot engagement members 22, 30 above the floor, ground or other support (i.e., height relative to the support surface) would not change depending on the profile of the cam surface (e.g., a flat or straight cam surface that parallels the support surface). While not practical, and more like a shuffle than a stride, this exercise presents a useful illustration. As can be understood, the forward-rearward motion of the foot engagement members 22, 30, and hence the right and left cam members 20, 28, may be independent of any downward-upward motion produced by rotation of the right and left crank arms 38, 42, and of the downward and upward motion of the user's feet that does occur during a normal exercise.

To further illustrate operation of the exercise device 10, if the user selects a stride length that closely matches the combined lengths of the right and left crank arms 38, 42, and moves the user's feet throughout the stride path coincident with the forward and rearward movement of the right and left rollers 36, 40 as the right and left crank arms rotate about the crank arm axle 70, there would be very little to no rearward-forward movement of the right and left cam members 20, 28 relative to their respective rollers 36, 40. If the rearward-forward foot movement of the user's feet, and hence the right and left cam members 20, 28 associated with the user's feet, does not match the rearward-forward movement of rollers 36, 40, relative rearward-forward movement occurs between each cam member 20, 28 and the roller 36, 40 supporting it.

As perhaps best depicted in FIG. 7 with respect to the right cam-link assembly 12 and right swing link 32, as the user operates the exercise device 10 and selects a stride length, the resulting rearward and forward movement of the right and left cam members 20, 28 combines with the downward and upward movement resulting from the rotation of the right and left crank arms 38, 42, to produce an elliptical or pseudo-elliptical stride path for the feet of the user to follow at each of the respective foot engagement members 22, 30. Specifically, FIG. 7 shows the stride path E resulting from movement of the right cam-link assembly 12 and right swing link 32 between position A (in solid lines) and position B (in dotted lines).

With continued reference to FIG. 7, as the user moves the right cam-link assembly 12 between positions A and B, the forward end of the right cam-link assembly 12 is displaced along the arcuate path between positions A and B via the pivotal connection of the right cam-link assembly 12 to the right swing link 32. As the user's stride length increases, the forward-rearward displacement of right cam-link assembly 12 on the right swing arm 32 forces the forward end of the right cam-link assembly 12 farther forwardly of the upright member 78 along the arcuate path, which tends to progressively lift the forward end upwardly farther away from the floor or ground or other support surface. The longer the user's stride, the more lifting that occurs.

Still referring to FIG. 7, during operation of the exercise device 10, the angle of the foot engagement members 22, 30 with respect to the frame 44 during use can be influenced or controlled by the configuration of the right and left cam-link assemblies 12, 14. That is, the angle of right foot engagement member 22 may change with respect to the frame 44 as the right foot engagement member 22 moves through its pseudo-elliptical stride path E. More particularly, the right engagement member 22 while positioned in the rear portion of the stride path E may be configured such that the rear portion of the right foot engagement member 22 is higher than the front portion. In contrast, the right foot engagement member 22 while positioned in the front portion of the stride path E may be configured such that the rear portion of the right foot engagement member 22 is lower than the front portion. As such, the angle of right foot engagement member 22 changes as it moves along its pseudo-elliptical stride path E.

The right first and second links 16, 18 may be configured to influence or control the positioning of the right foot engagement member 22 as it moves through its stride path E. That is, the second upper pivotal connections 54, 56 of the right first and second links 16, 18, respectively, connect the right cam member 20 and right foot engagement member 22 to the first and second links 16, 18 such that the positioning or angle of the right foot engagement member 22 as it moves through its stride path E is determined by these connections 54, 56. Thus, the length of each of the right first and second links 16, 18 influences the positioning of the right foot engagement member 22. A longer right second link 18 or a shorter right first link 16 would result in the right foot engagement member 22 being positioned such that the rear portion of the right foot engagement member 22 is relatively higher with respect to the front portion. Alternatively, a shorter right second link 18 or a longer right first link 16 would result in the right foot engagement member 22 being positioned such that the rear portion of the member is relatively lower with respect to the front portion. Similarly, the left cam-link assembly 14 and the left foot engagement member 30 operate in a like fashion.

As further depicted in FIG. 7, the amount and timing of the rearward-forward movement of the right and left cam members 20, 28 in relation to their rollers 36, 40 effects the shape of the elliptical or pseudo-elliptical stride path E experienced during the exercise. A shorter stride tends to produce a more circular or ovate path than the longer, flatter path produced by a longer stride. A stepping or jogging in place movement produces a generally vertically oriented path with little or no rearward-forward separation between the up and down halves of the path. The shape of the elliptical pseudo-elliptical stride path E can also be effected by the size components selected when manufacturing the exercise machine 10, for example by selecting shorter or longer right and left crank arms 38, 42, or right and left swing arms 32, 34. Additionally, changes in design can be made to select different placement of the right and left cam-link assemblies 12, 14 along the length of the right and left swing arms 32, 34. The path traveled by the right and left foot engagement members 22, 30 could be any partial section or length of a closed-loop stride path, which may be selectively varied by the user by the user varying the user's stride length.

Guide surfaces 21, 29 with arcuate shapes may be used to impact the stride that the user achieves during use of the exercise device 10. A striding motion applied by the user to the right and left foot engagement members 22, 30 normally drives the respective right and left cam members 20, 28 rearwardly and forwardly relative to their rollers 36, 40. However, if the forces applied by the legs of the user are insufficient to move the right and left cam members 20, 28 rearwardly and forwardly relative to their rollers 36, 40, the rollers 36, 40 maintain their position within the peaked central portion 23 of the guide surface 21. Accordingly, the right and left cam members 20, 28 move approximately the same distance as their respective crank arms 38, 42, both in the rearward-forward direction and in the downward-upward direction. Thus, if the user wishes to exercise allowing the right and left rollers 36, 40 to remain within the peaked central portions 23 of the guide surfaces 21, 29 of their respective cam members 20, 28, no rearward pushing force is required by the one leg of the user to move the one cam member rearward, and no forward force is required by the other leg of the user to move the other cam member forward since the rotation of the right and crank arms 38, 42 will move their respective cam members 20, 28 rearward and forward. The user generally must just shift the user's weight from one foot to the other foot to keep up with the right and left cam member 20, 28 movement resulting from rotation of their respective crank arms 38, 42. In this mode of operation, the length of the right and left crank arms 38, 42 determine the stride length.

In contrast, should the user apply more force via his legs to the foot engagement members 22, 30 to lengthen the user's stride, one of the right or left cam members 20, 28 moves rearward relative to the respective roller 36, 40 engaging the right or left cam member 20, 28 of respective cam-link assembly 12 or 14 and that roller 36, 40 rolls forward along the guide surface 21 toward the forward portion of the guide surface 21. The amount of force applied with a rearward-horizontal component determines how far forward the right or left roller 36, 40 moves since increasing energy is required as the right or left roller 36, 40 moves forward along the downwardly curving guide surface 21 since continuing to move the right or left roller 36, 40 forward requires the user to lift the user's body weight. The amount of lifting required is determined by the curvature of the guide surface 21 along which the right or left roller 36, 40 is rolling. The smaller the radius of curvature, the greater the amount of the rearward-horizontal component of force required since this increases the distance that the weight of the user must be lifted up. Because the user applies a rearward pushing force to the rearward moving right or left cam member 20, 28, this rearward moving right or left cam member 20, 28 tends to support most of the user's weight. The profile of the guide surface 21 may be varied to allow for different strides. According to one alternative embodiment, the guide surface 21 may include complex curves.

Generally, in an embodiment with an interconnection or dependency mechanism, when the user is lengthening the user's stride by pushing farther rearward with one foot, the user moves the other foot forward by a similar increased amount and causes the right or left cam member 20, 28 that foot is engaging to move forward relative to the right or left roller 36, 40 engaging that right or left cam member 20, 28. Further, the right or left roller 36, 40 rolls rearward along the guide surface 21 toward the rearward portion of the guide surface 21. The amount of force applied with a forward-horizontal component to accomplish this relative movement between the forward moving right or left cam member 20, 28 and its respective roller 36, 40 is significantly less than with the rearwardly moving right or left cam member 20, 28. This is because the forward moving right or left cam member 20, 28 is significantly unweighted. Accordingly, the force required to lift the right or left cam member 20, 28 is mostly related to the weight of the right or left cam-link assembly 12, 14 itself, which is likely not very large relative to the weight of the user. Additionally, the momentum of the right or left crank arm 38, 42 engaging its respective forward moving cam member 20, 28 and its direction of rotation tend to drive the cam member 20, 28 forward even without much, if any, help of the forward moving foot of the user. In use, the user will tend to shift his weight and begin the next stride due to the sensation felt with the rearward pushing leg, rather than because of any sensation felt with the forward moving leg, which mostly just moves forward along with the forwardly moving right or left cam member 20, 28.

When the radius of curvature of the guide/engagement surface 21 progressively decreases (i.e., the curvature increases) toward the ends of the right or left cam member 20, 28, the increased energy the user must input dissuades moving the right or left cam members 20, 28 relative to their respective rollers 36, 40 so far as to reach the physical ends of the guide/engagement surface 21. In fact, after several striding cycles by a user on the exercise machine 10, the progressively increasing nature of the force encountered when reaching the end of a long stride tends to train the user to sense and respond to the increase in force, thus providing an indication to the user to shift the user's body weight and avoid using overly long stride lengths that might drive the right or left rollers 36, 40 to the ends of guide/engagement surface 21 of their respective cam members 20, 28. The user tends to respond to this increase in force subconsciously and it stimulates a weight shift to begin a new stride while well within the physical parameters of the exercise machine 10 as manufactured.

When a user wishes to stride with a stride length shorter than that resulting from allowing the right or left cam members 20, 28 to travel with their respective rollers 36, 40 by allowing the respective rollers 36, 40 to remain within the peaked central portion 23 of their guide surface 21, the user may oppose the tendency of the right or left cam members 20, 28 to be carried with their respective rollers 36, 40 as the right and left crank arms 38, 42 rotate during an exercise. Effectively, the user applies a forward moving force on the rearward moving right or left cam member 20, 28 to which the user would normally apply a rearward pushing force when desiring a long stride so as to drive the right or left cam member 20, 28 forward relative to the right of left roller 36, 40 engaging it. Similarly, the user must apply a rearward moving force on the forward moving right or left cam member 20, 28 to which the user would normally apply a forward force so as to drive this right or left cam member 20, 28 rearward relative to the roller 36, 40 engaging it. This is not very difficult with a little practice, and produces a shortened stride length or even a jogging or stepping in place stride path that stimulates substantially different muscle involvement than for the exercises first described.

While a forward striding exercise movement by the user has been described, the user can also exercise on various embodiments of the exercise machine 10 by performing a rearward striding movement (i.e., running backwards while still facing forward toward the upright member 78). The user need only apply his weight to the appropriate foot engaging member to cause the initial rotational movement of the right and left crank arms 38, 42 to be counterclockwise as viewed from the right side in FIG. 1. The shifting of the user's weight between the foot engagement members occurs in the reverse of what has previously been described for forward striding. The user may also face rearward on the exercise machine 10. In other words, the user may face away from the upright member 78 when using the exercise machine 10.

Figure 13:
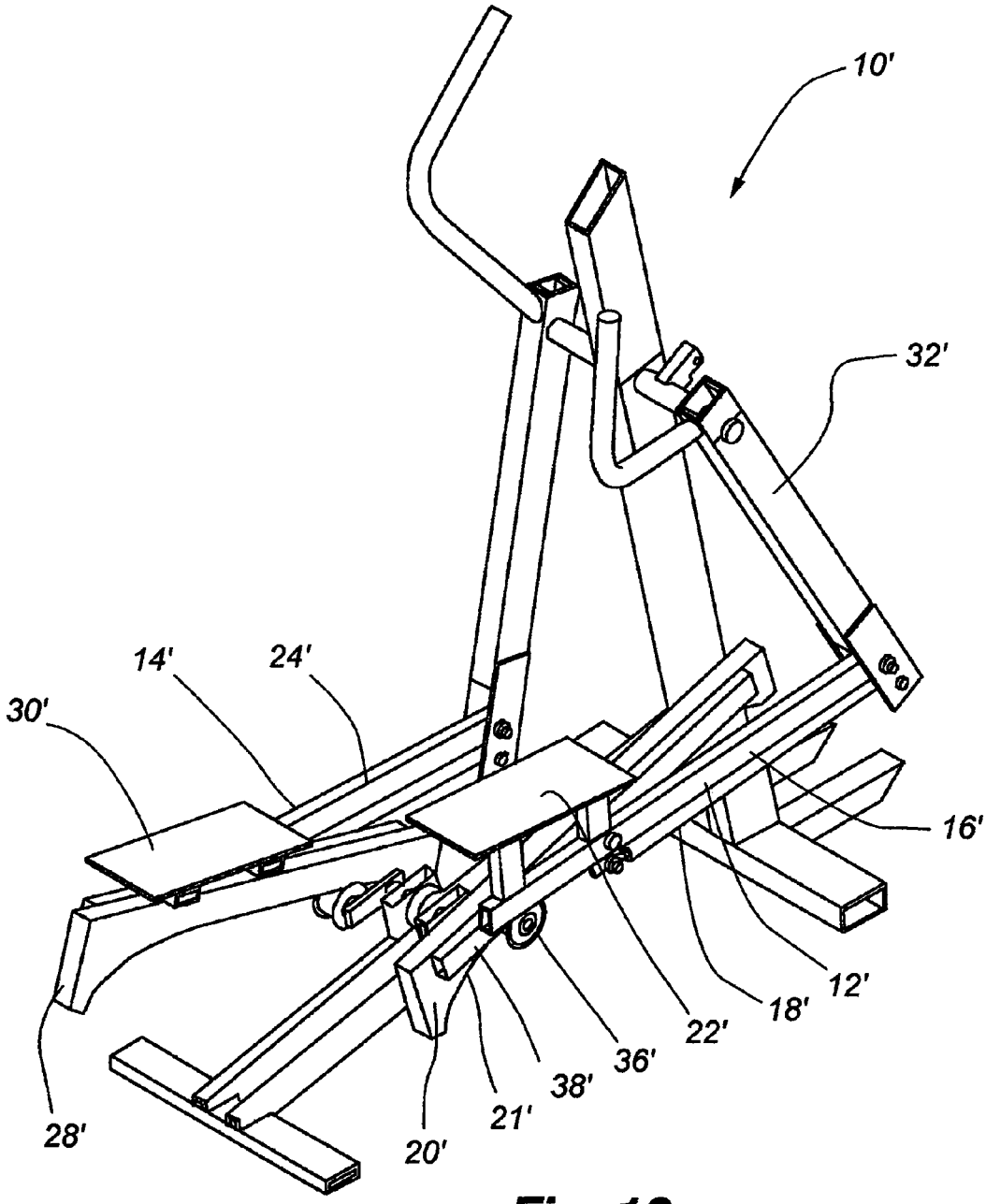
FIG. 13 depicts a perspective view of another embodiment of an exercise device, which is structurally and operationally similar to the exercise device shown in FIG. 1.

FIG. 13 depicts another embodiment an exercise device 10' for variable stride exercises. In this embodiment, the right and left foot engagement members 22', 30' are connected to the right and left first links 16', 24' instead of their respective cam members 20', 28'. Other than the disposition of the engagement members 22', 30', the cam-link assemblies 12', 14' are configured similarly to the embodiment of FIG. 1. That is, with reference to the right cam-link assembly 12', the first and second link members 16', 18' are operably and pivotally coupled to the right swing link 32' at one end and further operably and pivotally coupled to the right cam member 20' at the other end. Further, the downwardly disposed guide surface 21' on the right cam member 20' rotatably engages the right roller 36' on the right crank arm 38'. Given that the components of the left cam-link assembly 14' are substantially mirror images of the right cam-link assembly 12' components, the above description with respect to the right cam-link assembly 12' apply equally to the left cam-link assembly 14'.

Figure 14:
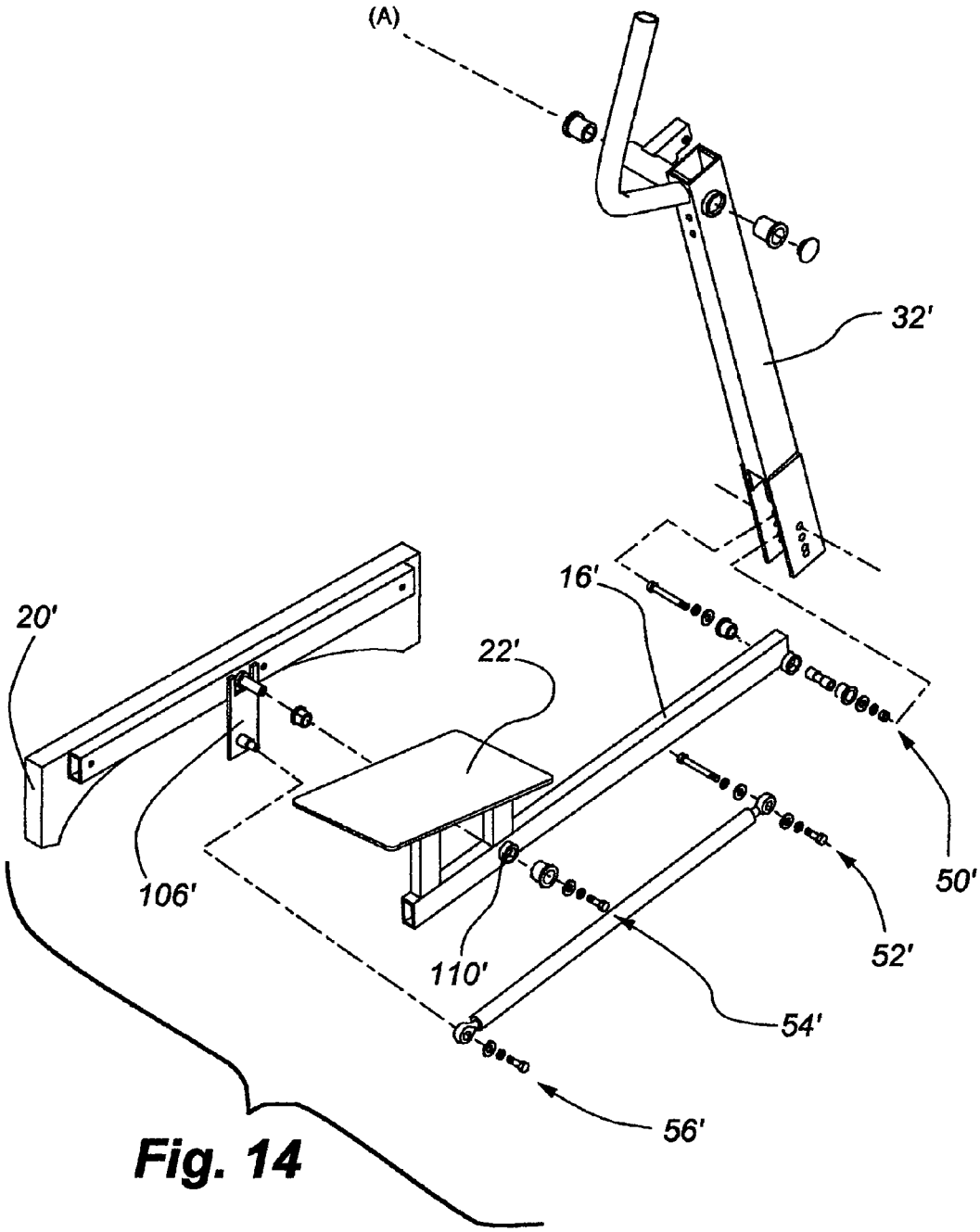
FIG. 14 depicts a partially exploded perspective view of a cam-link assembly of an exercise device shown in FIG. 13.

Further, as depicted in FIG. 14, the pivotal connections of the cam-link assemblies 12', 14' according to an alternative embodiment are similar to the connections in the embodiment of FIGS. 1 and 1B. More specifically, pivotal connections 50', 52', and 56' generally may have substantially the same configuration as the equivalent pivotal connections shown in FIG. 1B. As shown in FIG. 14, the second upper pivotal connection 54' is not disposed at the end of the right first link 16', but rather is disposed between the ends of the first link 16'. In the embodiment depicted in FIG. 14, the hole 110' is disposed directly under the front beam of the right foot engagement member 22'. Alternatively, the hole 110' can be disposed anywhere along the length of the link 16' so long as it is rearward in relation to the first upper pivotal connection 50'.

Figure 15:
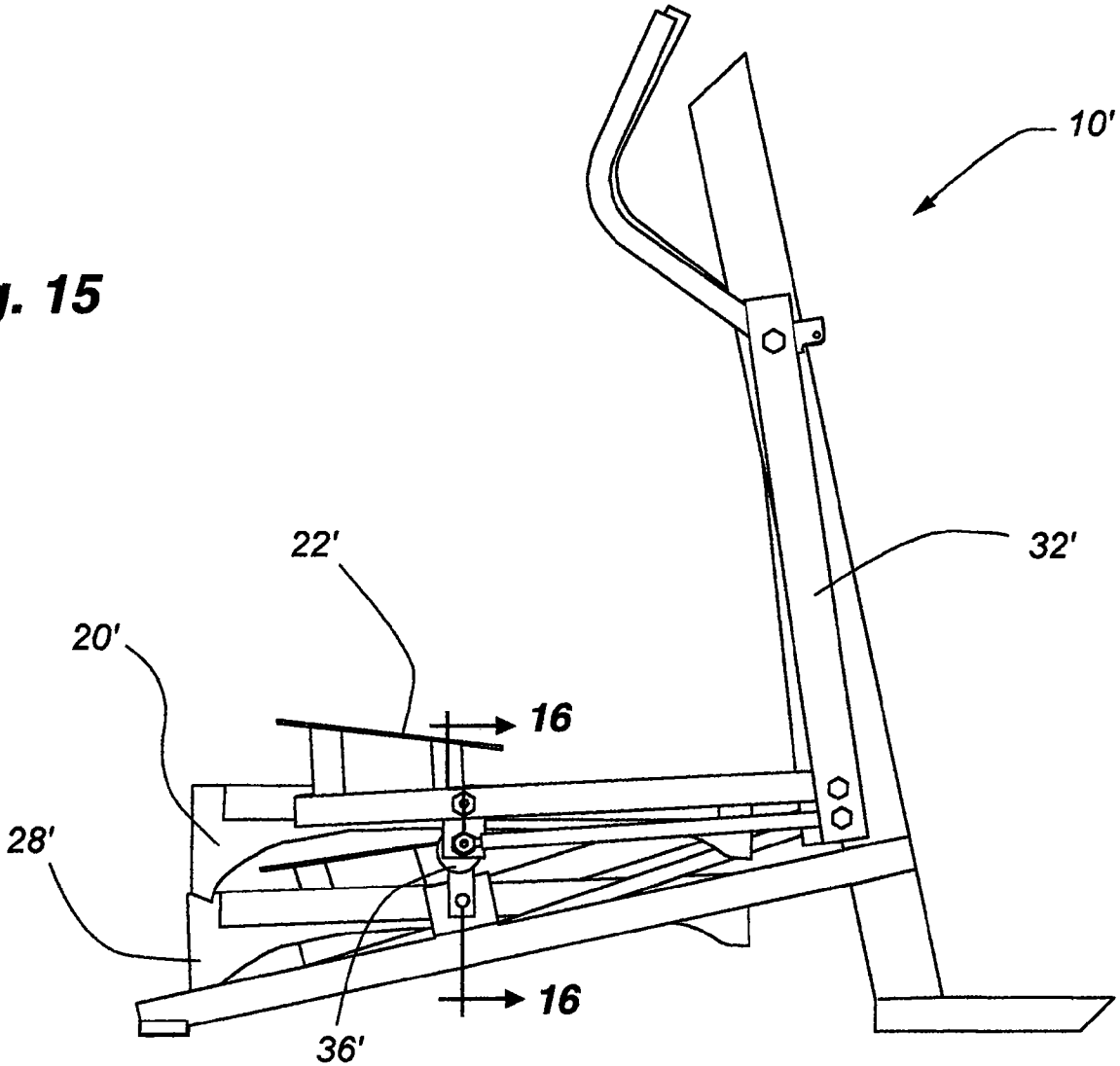
FIG. 15 depicts a side view of an exercise device shown in FIG. 13.
Figure 16:
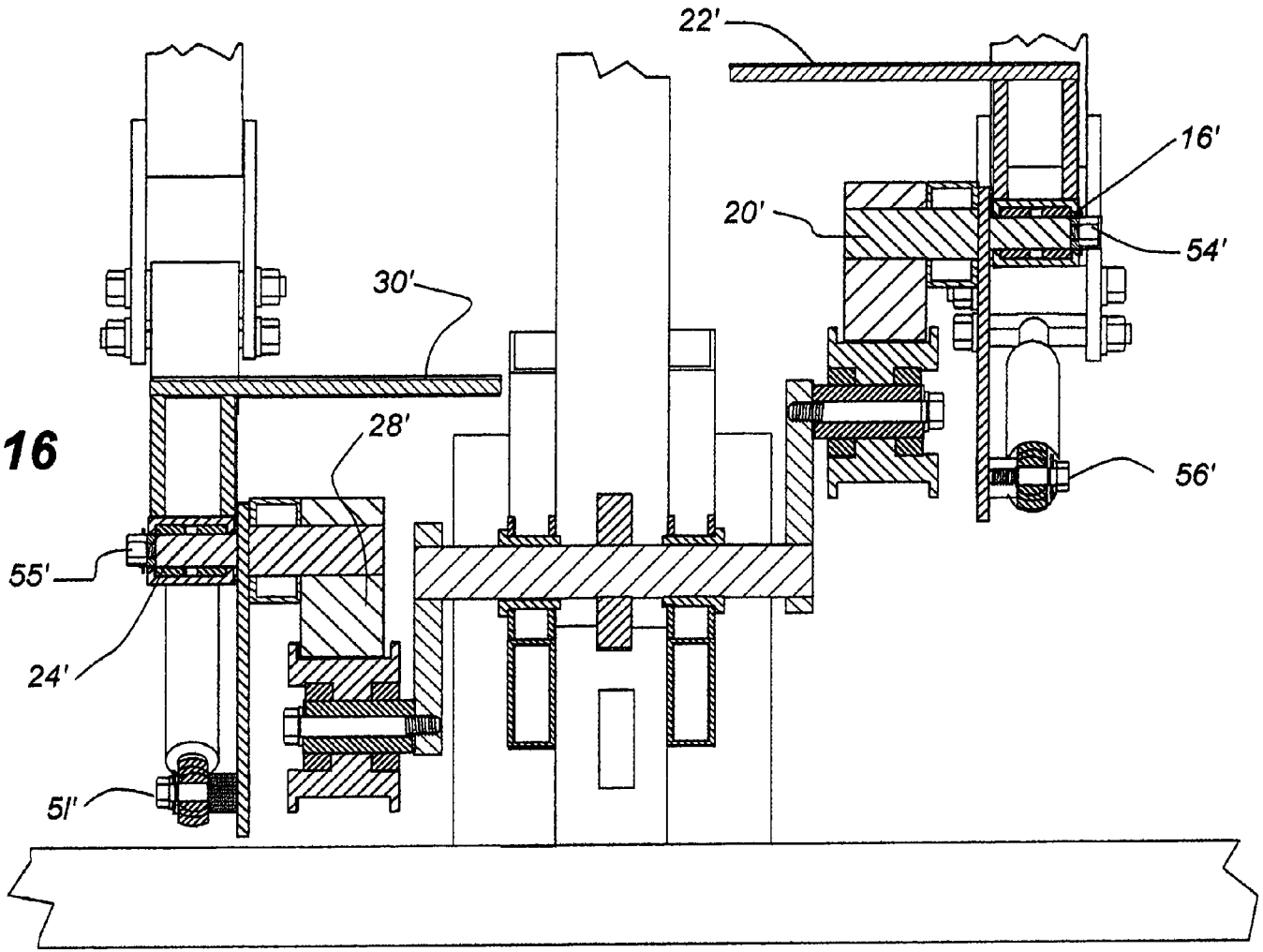
FIG. 16 depicts a partial rear cross-section view of the exercise device shown in FIG. 1, viewed along line 16-16 in FIG. 15.

FIG. 15 is a right side view of the exercise device 10' depicted in FIG. 13. FIG. 16 is a partial rear cross-section view along line 16-16 in FIG. 15. The pivotal connections 54', 55', 56', and 57' are generally similar to the equivalent pivotal connections of the embodiment depicted in FIG. 3. The foot engagement members 22', 30' are operably coupled to the right and left first link members 16', 24' instead of their respective cam members 20', 28'.

FIGS. 17-26 show various views of a third embodiment of an exercise machine 200, which is substantially similar in structure and operation to the first embodiment of an exercise apparatus 100 shown in FIG. 1. In these figures, like reference numbers are used for structures or assemblies that are similar to the structures and assemblies of the first embodiment of an exercise machine 100. Similarities and differences between the third embodiment of an exercise machine 300 and the first embodiment of an exercise machine 100 are described below. As with the previously described embodiments, reference may be made to components, structures and so on with respect to one-side, either the right or the left, of the exercise machine 300 with the understanding that the structure and operation of the counterpart or corresponding component or structure on the other side is structurally and functionally the same or substantially similar.

Figure 17:
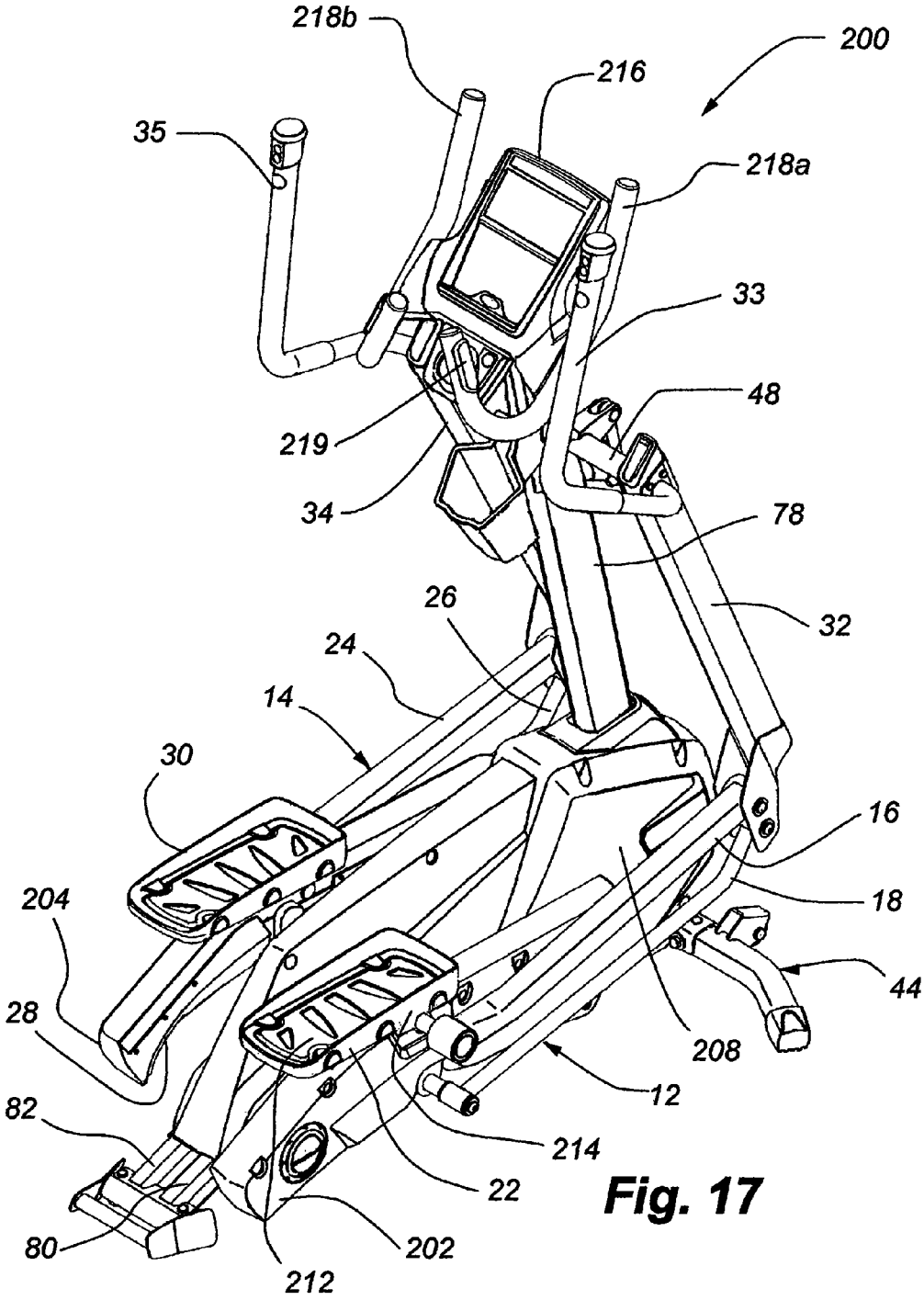
FIG. 17 depicts a perspective view of an exercise device similar in operation and structure to the one depicted in FIG. 1.

FIG. 17 depicts the third embodiment of an exercise machine 300. Like the first embodiment, the third embodiment an exercise machine may include right and left swing links 32, 34, right and left cam-link assemblies 12, 14, and right and left foot engagement members 22, 30. Like the first embodiment, each swing link 32, 34 may be operably coupled to a frame 44 for pivotal movement. More particularly, each swing link 32, 34 may be pivotally attached to a swing arm pivot axle 48 support by an upright member 78. Like the first embodiment, the right and left swing link 32, 34 may be pivotally attached the swing arm pivot axle 48 using any known system or method for pivotally attaching one member to another member.

Similar to the first embodiment of an exercise device 100, right and left handles 33, 35 may be joined to the right and left swing links 32, 34, respectively. As described above with respect to the first embodiment, the right and left handles 33, 35 may be configured for grasping by a user, thus providing the user with a structure to hold while exercising on the exercise machine 200. Further, by pushing and/or pulling on the right and left handles 33, 35, the user may exercise the user's upper body when exercising with the exercise machine 200. As discussed in more detail above with respect to the first embodiment, the right and left handles 33, 35 may be fixedly or selectively movably joined to the right and left swing links 32, 34. For example, as shown in FIG. 17, the right handle 33 may be joined to a handle plate, which may be mechanically fastened to the right swing link 32 using fasteners, such as bolts, screws, rivets or the like. However, as discussed above, any known joining or integral system may be used to join or integrally form the right and left handles 33, 35 to their respective swing links 32, 34.

Figure 18:
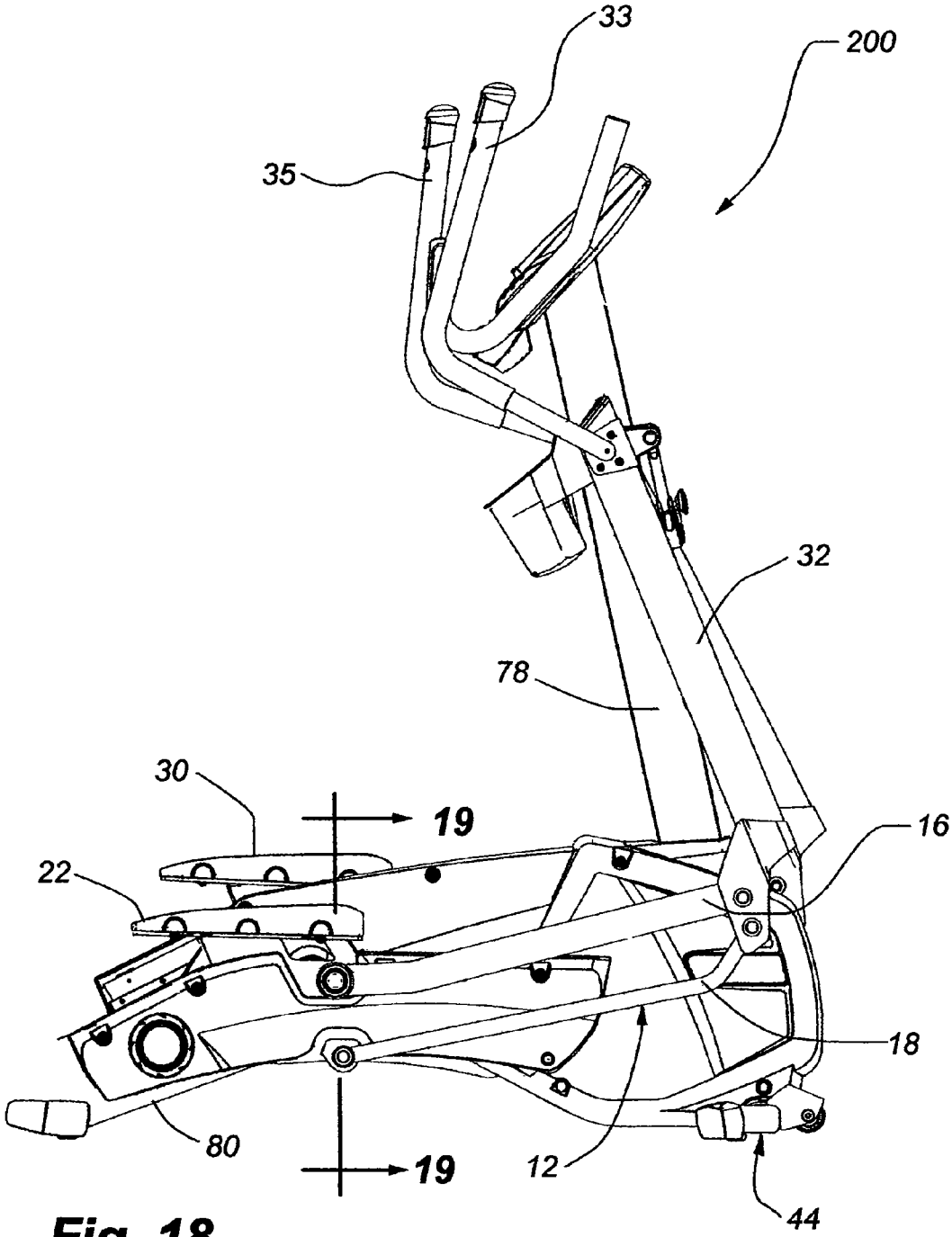
FIG. 18 depicts a side view of the exercise device shown in FIG. 17.
Figure 19:
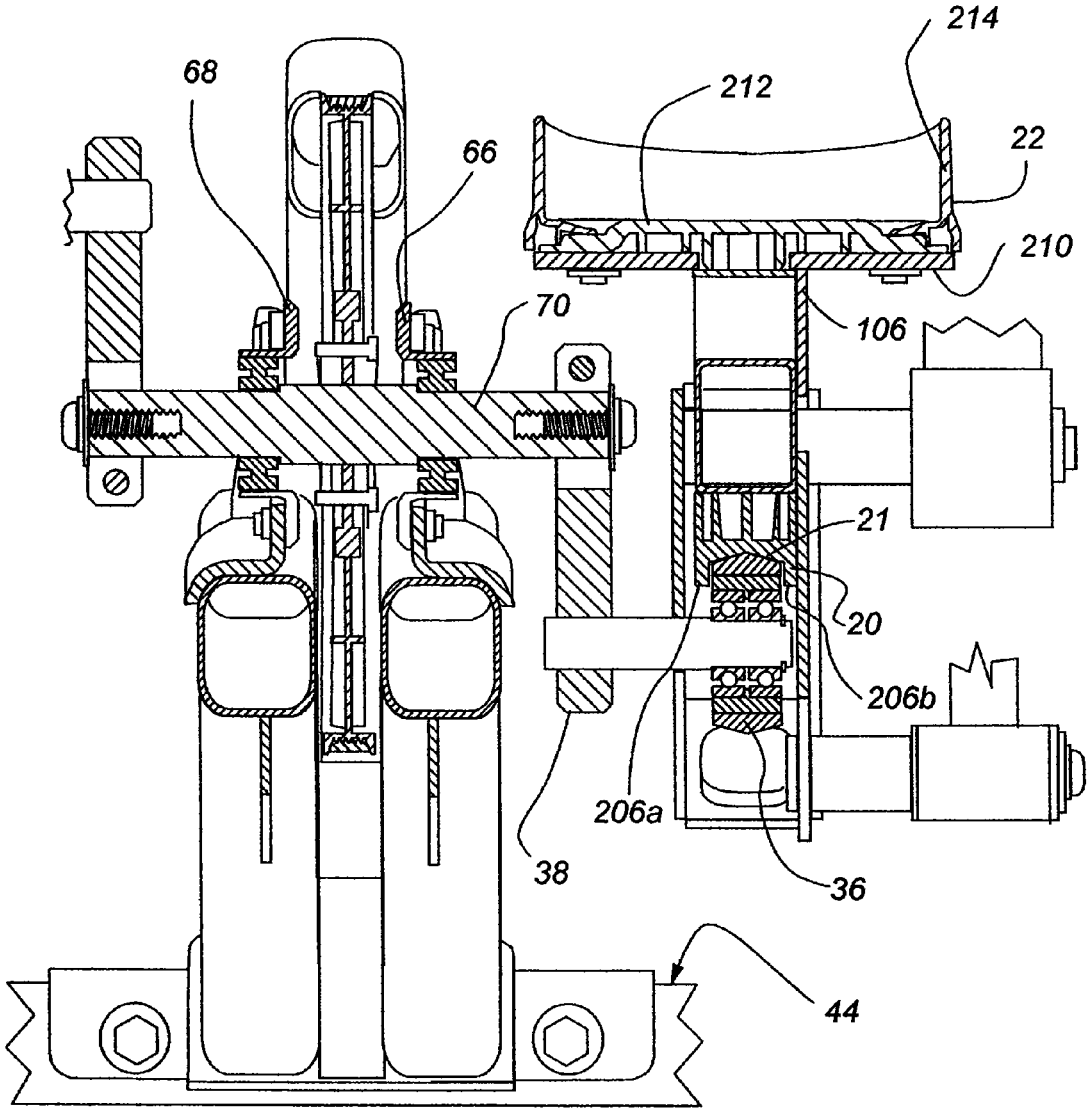
FIG. 19 depicts a partial cross-section view of the exercise device shown in FIG. 17, view along line 19-19 in FIG. 18.

With reference to FIGS. 17-19, like the first embodiment, the right cam-link assembly 12 may include first and second right links 16, 18 and a right cam member 20, and the left cam-link assembly 14 may include first and second left links 24, 26 and a left cam member 28. As with the first embodiment, the first right and left links 16, 24 and the second right and left links may be each pivotally coupled to a respective swing link 32, 34 at one end portion and to a respective cam member 20, 28 at their opposite end portions using any known system or method for pivotally attaching various components together. Further, like the first embodiment, the links 16, 24, 26, 28 may be operatively associated with structures other than the swing links 32, 34 that constrain the links to move a pre-determined path.

The first right link 16 may take the form of a generally linear, square tube that is bent upwardly near an end portion proximate the right cam member 20. The second right link 18 may take the form of a generally linear, circular tube that is bent upwardly near an end portion proximate the right swing member 32. The first and second left links 24 and 26 may take forms similar to the first and second right links, respectively. Such bends may allow for the first and second right links 16, 18 to be joined to the right swing member 32 at relatively close locations while allowing for adequate clearance distance between the first and second right links 16, 18 as they move towards each other as the right swing arm 32 pivots around the frame 44. However, although shown and described with specificity, the first right and left links 16, 24 and the second right and left links 18, 26 may take any desired shape or form as long as they provide suitable structures for operably joining their respective swing arms 32, 34 to their respective cam members 20, 28. Further, as discussed in more detail above, the lengths of each link 16, 18, 24, 26 may be selected to cause their respective foot engagement members 22, 30 to be positioned at certain angles during movement of the foot engagement members 22, 30 during an exercise.

With particular reference to FIG. 19, the right cam member 20 may be supported by a right roller 36 supported by a right crank arm 38 in manner similar to the one described above for the first embodiment of an exercise device 100. As discussed in more detail above, the right roller 36 engages an engagement or guide surface 21 of the right cam member 20 such that the right cam member 20 may move in a forward-rearward direction relative to the right roller 36, thus allowing a user to vary the user's stride path without requiring the changing of the machine's settings or structures. Like the first embodiment, other suitable structures may be used to allow the right cam member 20 to move relative to the right crank arm 38.

The right cam member 20 may include a pair of cam member engagement surface sidewalls 206*a-b* that generally extend downwardly from the cam member 20 on each side of the engagement surface along the length thereof. These engagement surface sidewalls 206*a-b* may partially extend beyond an upper portion of the right roller 36 on each side of the right roller 36, thus helping to maintain lateral alignment (i.e., alignment to the right and left hand side of the drawing) of the right roller 36 with respect to the engagement surface 21. As described above, such lateral alignment may be maintained, if desired, using flanges formed on the right roller 38 or by some other known or otherwise suitable method.

With continued reference to FIG. 19, the right crank arm 38 may be rotatably supported from the frame 44 in a manner similar to the one described above for the first embodiment of an exercise device 100. More particularly, the right crank arm 38 may be joined to a crank arm axle 70, which may in turn be rotatably supported by right and left crank arm suspension components 66, 68 using bearings or other suitable components that allow the crank arm axle 70 to rotate relative to the frame 44. The right crank arm 38 may be secured to the crank arm axle 70 using a mechanical fastening system, such as the washer and threaded bolt shown in FIG. 19, or by any other known connection system, including, but not limited to, welding or adhering. Further, the right crank arm 38 may, if desired, be integrally formed with the crank arm axle 70 by any known method, including casting, injection molding, and the like.

Returning to FIGS. 17 and 18 and with continued reference to FIG. 19, like the first embodiment, the right foot engagement member 22 may be supported by the right cam member 20. More particularly, the right foot engagement member 22 may be joined to the right cam member 20 using a connection plate 106. The connection plate 106 may include a support portion or member 210 joined to the right foot engagement member 22 using one or more mechanical fasteners, such as bolts, screws, rivets, or the like. Although the right foot engagement member 22 is shown as mechanically fastened to the connection plate 106, any known connection method, such as any connection method describe above, may be used to join to it to the connection plate 106. Likewise, the connection plate 106, in turn, may be joined to the right cam member 20 by any known connection manner, thus operatively joining the right foot engagement member 22 to the right cam member 20.

The right foot engagement member 22 may include an engagement member base portion 212 for supporting a user's foot. Recesses as shown in FIG. 17, or ridges (not shown), or other gripping enhancing elements, such as rubber grip mats or the like, may be defined in, or attached to, the engagement member base portion 212 to increase or otherwise enhance the friction between a user's foot and the right foot engagement member 22, thus providing for a more effective transfer of forces from the user's lower body to the right foot engagement member 22 and/or reducing the likelihood of the user's foot sliding relative to the right foot engagement member 22 while exercising.

An engagement member sidewall 214 may extend generally upward from the engagement member base portion 212 from the right, left and front sides of the engagement member base portion 212. Together, the engagement member base portion 212 and the engagement member sidewall 214 define a region for receiving a user's foot. The engagement member sidewall 214 may function as a safety feature by reducing the risk of a user's foot sliding off the right foot engagement member 22 should the user's foot slip laterally to the right or left or slip forward while using the exercise machine 200.

Figure 20A:
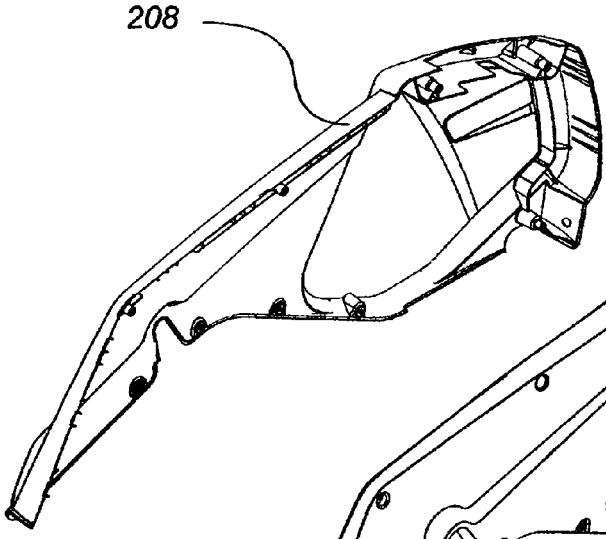
FIGS. 20A-E depict perspective views of covers for use with the exercise device shown in FIG. 17.
Figure 20C:
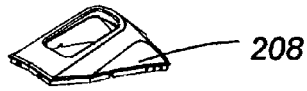
Figure 20B:
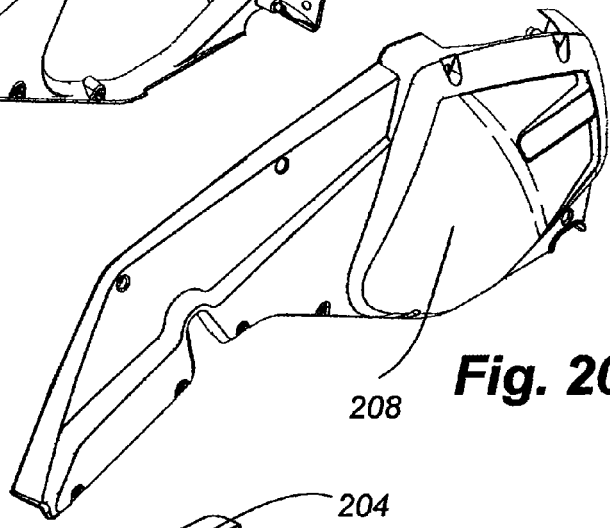
Figure 20D:
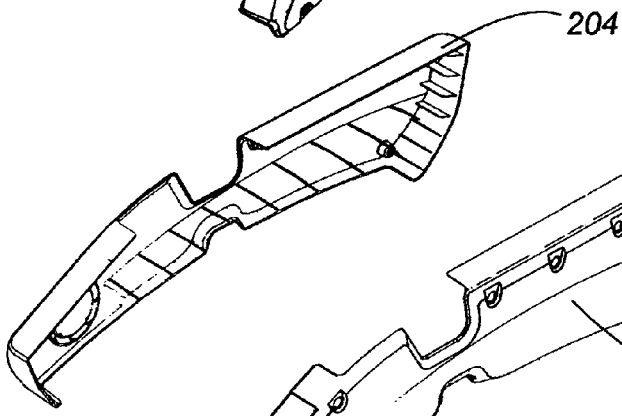
Figure 20E:
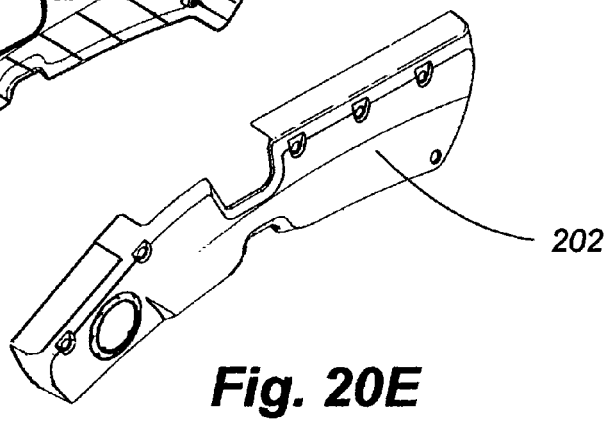

With continued reference to FIGS. 17, 20D and 20E, the third embodiment of an exercise device 300 may further include right and left cam member covers 202, 204. The right and left cam member covers 202, 204 may each be attached to its respective cam member 20, 28 using mechanical fasteners, welds, adhesives, or any other known connection system or method for joining together individual components. If desired, the right and left cam member covers 202, 204 may also be integrally formed with their respective cam member 20, 28 by casting, injection molding, or any other known method to form a unitary component. Each right and left cam member cover 202, 204 may generally encompass the front, back, top and outwardly facing sides of its respective cam member 20, 28. Such encompassing may generally obscure the right and left cam members 20, 28 from view by the user. Further, such encompassing may generally limit or restrict access to right and left rollers 36, 40 that engage and move relative a respective cam member 20, 28 in a manner similar to the one described above with respect to the first embodiment of an exercise device 100, thus functioning as a safety feature by limiting the potential for a user or other persons to injure themselves by having clothing or a body part caught or trapped between these moving components. Yet further, the right and left cam members 202, 204 may be formed into a visual pleasing shape to increase the aesthetic appeal of the exercise machine 300.

The third embodiment of an exercise device 300 may yet further include one or more frame covers 208 as shown in FIGS. 17 and 20A-C. The one or more frame covers 208 may be attached to the frame 44 in a manner similar to any joining method described above with respect to the right and left cam covers 202, 204. The one or more frame covers 208 may be configured to define enclosed or substantially enclosed spaces or areas for receiving various components, such as resistance devices, flywheels, and so on, of the exercise device 300. Like the right and left cam covers 208, the one or more frame covers 208 may function as a safety feature by limiting or restricting access to moving components of the exercise device and/or may be formed into visually appealing shapes to increase or enhance the aesthetic appeal of the exercise machine 300.

Returning to FIG. 17, the third embodiment of an exercise device 300 may include a control unit or console 216. The control unit 216 may be supported at an upper portion of the upright member 78. The control unit 216 may include a control housing defining an enclosed or substantially enclosed space for containing one or more electronic devices, such as controllers, or other electronic hardware or circuitry. The electronic hardware may be configured to receive user input from a control panel or other input device operatively associated with the electronic hardware and to generate or transmit output signals responsive to the user input. For example, as described in more detail below, a controller or other suitable device may be configured to receive input and in response to the input deliver an output signal to a device operatively associated with a resistance mechanism in order to increase or decrease the difficulty of performing an exercise using the exercise device 300.

The control panel may be positioned on or otherwise supported by the control unit housing. The control panel may include a keypad, dials, buttons or other suitable devices for a user to touch or move to control the various electronic hardware associated with the exercise device 300. The control panel may further include a visual display for providing information to the user, such as the resistance level, exercise time, estimated calories burned, estimated speed, revolutions per minute for the foot engagement members, user power output, user heart rate, or any other information that may be of interest with respect to the workout. Such information may be collected, generated, or calculated using the electronic hardware and circuitry, sensors, or other known devices for collecting, generating, or calculating information related to a workout. The control unit housing may further contain or support computer, television, or other monitors for displaying media or other content.

The exercise device 300 may further include receivers and transmitters for receiving and/or transmitting wireless signals. Such wireless signals may be used to control one or more controllers or other electronic hardware associated with the exercise device 300, to deliver programs or other software for controlling the electronic hardware, or even to deliver media or internet content to the exercise device 300. For example, for group exercise programs, a wireless signal may be used by a group leader to adjust the resistance of the exercise device 300 during the group exercise. As another example, the exercise device 300 may include software and hardware for preprogrammed workout routines. Continuing with the example, a wireless signal may be used to upload new or updated preprogrammed workout routines.

Right and left stationary handles 218*a-b* may be attached to the control unit 216. These stationary handle 218*a-b* may provide a non-moving member for a user to grasp while exercising. The right and left stationary handles 218*a-b* may be attached to the control unit 216 using any known connection method, including any method described above for connecting the right and left handles 33, 35 to the right and left swing links 32, 34. Although shown as attached to the control unit 216, the stationary handles 218*a-b* could be attached to any non-moving element (e.g., the upright member 78) of the exercise device 200. The right and left stationary handles 218*a-b* may further include electrodes 219 or other devices for measuring the heart rate of a user as known in the art of heart rate measuring. Such electrodes or other devices for measuring a user's heart rate may also be included with the right and left handles 33, 35.

Figure 21:
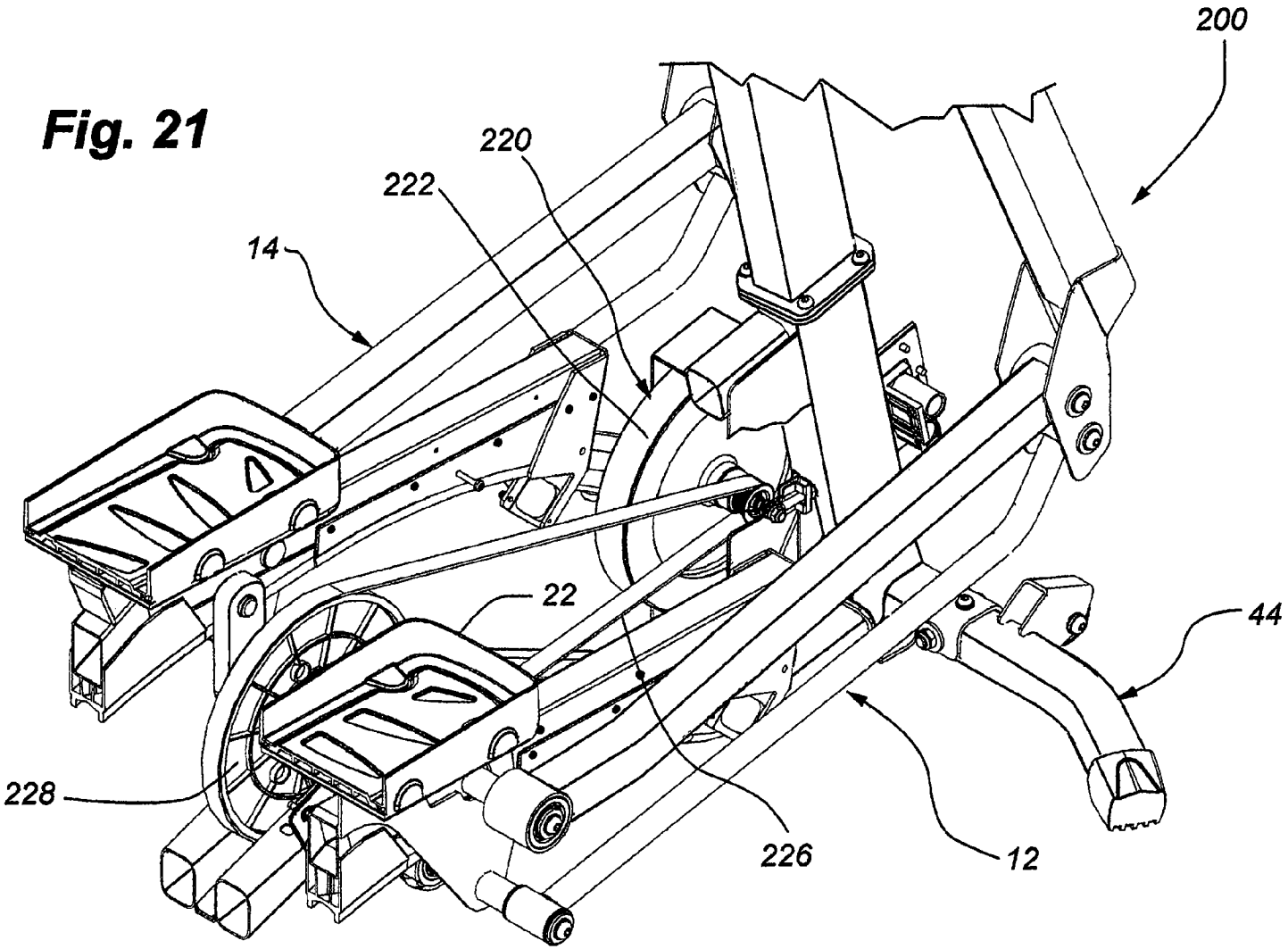
FIG. 21 depicts a perspective view of a portion of the exercise device shown in FIG. 17, showing the right and left cam-link assemblies and the resistance mechanism.
Figure 22:
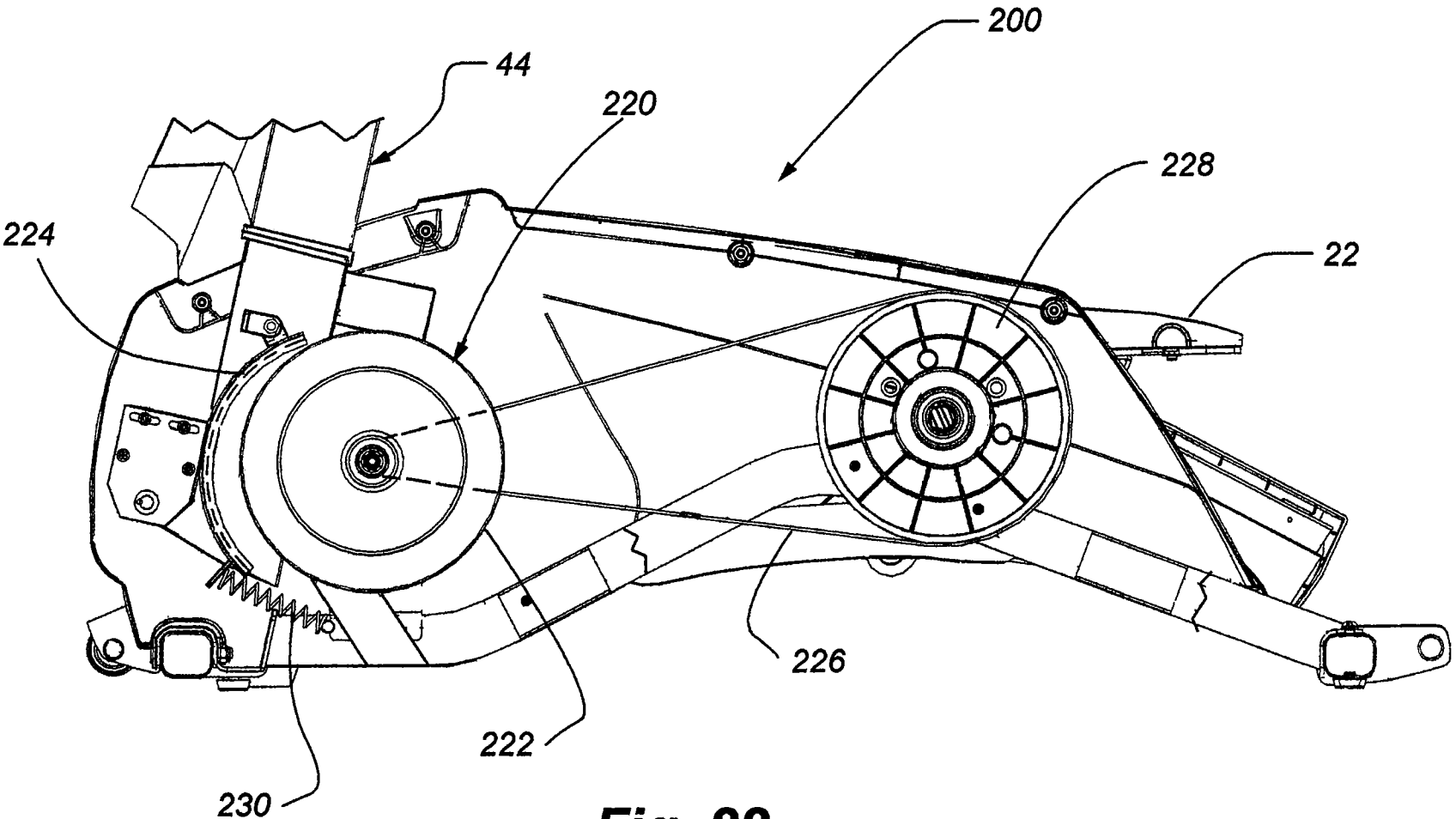
FIG. 22 depicts a side view of a portion of the exercise device shown in FIG. 17, showing the resistance mechanism.
Figure 23:
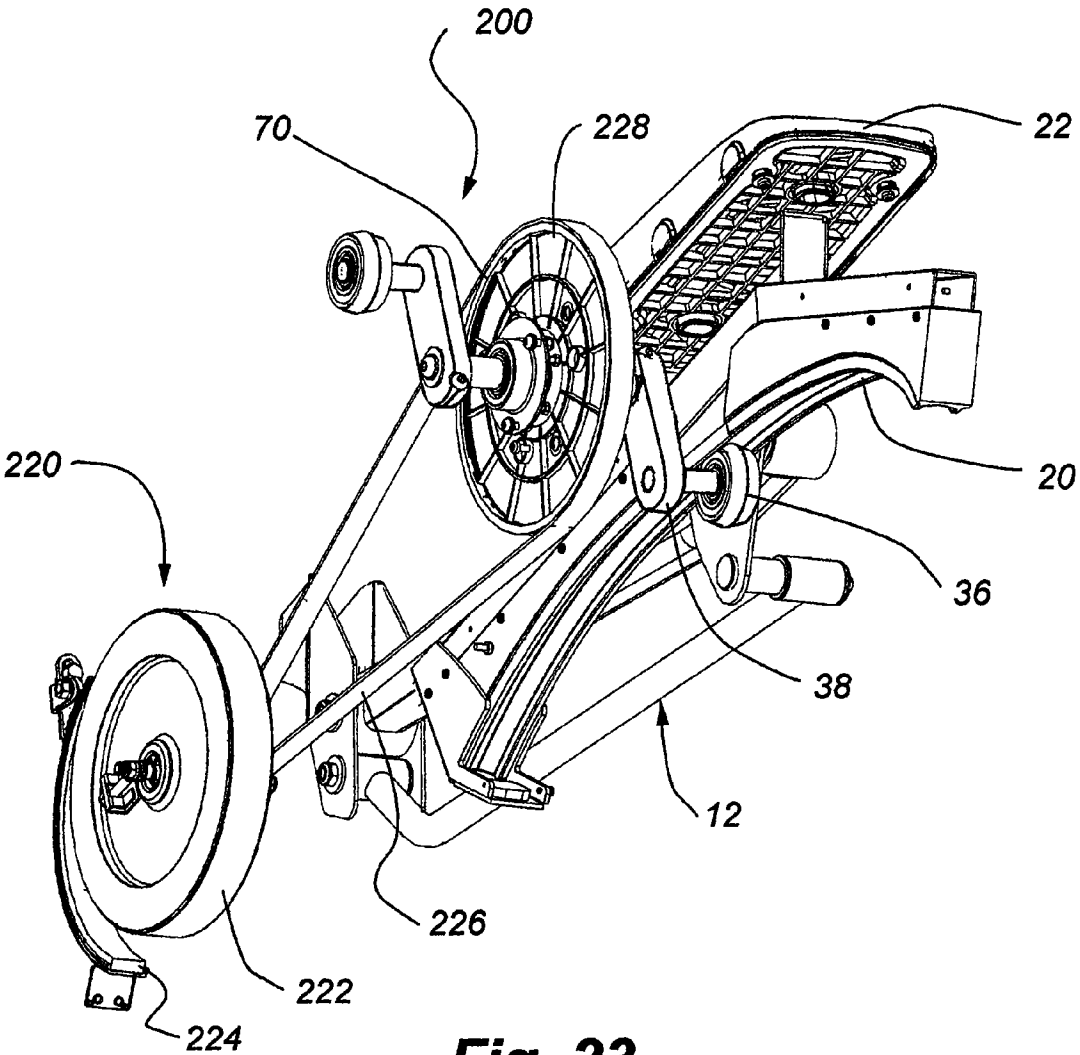
FIG. 23 depicts a perspective view of a portion of the exercise device shown in FIG. 17 showing the right cam-link assembly and the resistance mechanism.
Figure 24:
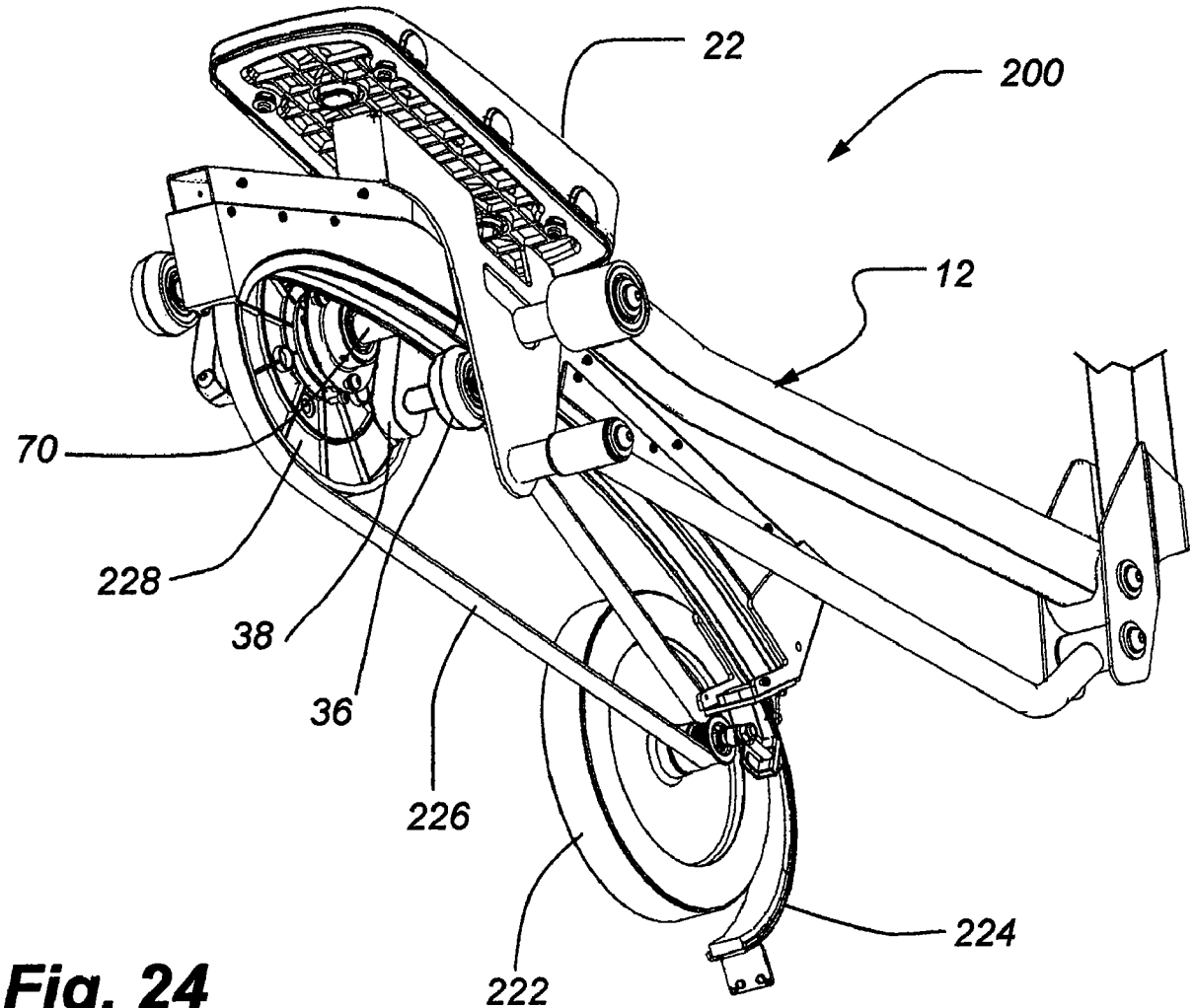
FIG. 24 depicts another perspective view of the right cam-link assembly and the resistance mechanism shown in FIG. 23.

FIG. 21 shows a partial perspective view of the exercise machine 200 with the various coverings removed to show better show the right and left cam-link assemblies 12, 14 and the resistance mechanism. FIG. 22 shows a left side view of the exercise machine with the various left-side coverings, the left cam-link assembly, and left swing link removed to show the resistance mechanism. FIG. 23 depicts a perspective view of the right cam-link assembly 12 and the resistance mechanism for the exercise device 200. FIG. 24 depicts another perspective view of the right cam-link assembly 12 and the resistance mechanism for the exercise device 200.

With reference to FIGS. 21-24, the exercise device 200 may include a resistance mechanism operatively coupled with the right and left cam-link assemblies 12, 14. The resistance mechanism 220 may be selectively adjusted to increase or decrease the difficulty of an exercise by increasing or decreasing the difficulty of rotating the right and left crank arms. The resistance mechanism 220 may include a flywheel 222, a magnetic device 224, a resistance belt 226, and a resistance pulley 228.

The flywheel 222 may be rotatably supported by the frame 44 in manner similar to any described above for rotatably supporting the crank arms or by any known method for rotatably supporting a flywheel 222 or the like from a frame 44. The flywheel 222 may be operatively joined to the right and left cam-link assemblies 12, 14 using the resistance belt 226 and the resistance pulley 228. More particularly, the resistance belt 226 may be joined a flywheel 222 and the resistance pulley 228 such that rotation of the resistance pulley 228 is transmitted by the resistance belt 226 to cause rotation of the flywheel 222. The resistance pulley 228, in turn, is joined to the crank arm axle 70 to rotate therewith. Accordingly, as a user moves the right and left foot engagement members 22, 30, the user rotates the crank arm axle 70 as described in more detail above. Rotation of the crank arm axle 70 causes rotation of the resistance pulley 228, which in turn causes rotation of the flywheel 222 via the resistance belt 226. Although the flywheel 222 and the resistance pulley 228 are shown as joined by a resistance belt 226, any suitable structure or system for operatively joining the flywheel 222 to the resistance pulley 228, including, but not limited to, chains, cables, links and so on, may be used. Yet further, other known mechanisms other than a belt and pulley may be used to cause movement of the flywheel 222 in response to movement of either the right or left foot engagement member 22, 30.

Resistance to the movement of either the right and left foot engagement members 22, 30 may be provided by the magnetic device 224. More particularly, the magnetic device 224 may take the form of one or more magnets positioned proximate the flywheel 222, which may be composed of a conductive metal or other suitable conductive material. As the flywheel 222 rotates near the magnetic device 224, eddy currents develop that resist rotation of the flywheel 222. Since, as described above, the flywheel 222 is operatively coupled to the right and left foot engagement members 22, 30, this resistance to rotation imposed on the flywheel 222 via the eddy currents is transmitted to the right and left foot engagement members 22, 30, thus providing resistance to a user's efforts to move the right and left foot engagement members 22, 30. As the magnetic device 224 is positioned closer to the flywheel 222, the resistance to rotation of the flywheel 222 increases, thus increasing the resistance to movement of the right and left foot engagement members 22, 30.

The magnetic device 224 may include an arcuate shaped or other suitably shaped member for supporting the magnets. The magnetic device 224 may be pivotally or otherwise movably joined to the frame 44 at one end portion and may be joined to a magnetic device spring 230, or other biasing member, at the other end. The magnetic device spring 230 may be joined to servo-motor (not shown), or other suitable device for moving the magnetic device spring 230, via a cable or other link (not shown). The servo-motor may, in turn, be associated with a controller (not shown) configured to operate the servo-motor and to receive input that results in activation of the servo-motor. In response to this input, the servo-controller may be used to move the magnetic device 224 closer to or farther away from the flywheel 224 to adjust the resistance provided by the resistance mechanism 220.

More particularly, the servo-motor may be configured to move an end of the magnetic device spring 230 either towards or away from its initial position. As the magnetic device spring 230 is moved, it transmits a force to the magnetic device 224 that causes the magnetic device 224 to either pivot towards or away from the flywheel 222 depending upon the direction the magnetic device spring 230 is moved. As described above, as the magnetic device 224 pivots or otherwise moves closer to the flywheel 222, the resistance to movement of the flywheel 222 increases, and as the magnetic device 224 pivots or otherwise moves farther from the flywheel 222, the resistance decreases. Accordingly, a user via input to the controller may selectively increase or decrease the resistance provided by the resistance mechanism 220, and thus increase or decrease the difficulty of moving the right and left engagement members 22, 30.

Although shown and described with particularity, the resistance mechanism 220 may take the form of any known resistance mechanism used in exercise machines or otherwise. Further, for embodiments with an interconnection between the right and left swing links 32, 34, the resistance mechanism may be operatively associated with one or both of the right and left swing links 32, 34 rather than the right and left foot engagement members 22, 30 for selectively increasing or decreasing the difficulty of moving the right and left foot engagement members 22, 30. Yet further, one or more resistance mechanisms may be operatively associated with one or more of the right and left foot engagement members 22, 30 and right and left swing links 32, 34. Still yet further, the one or more resistances mechanisms may be configured to provide substantially the same or different resistances to each such member 22, 30, 32, 34 that the resistance mechanisms may be operatively associated with.

Figure 25:
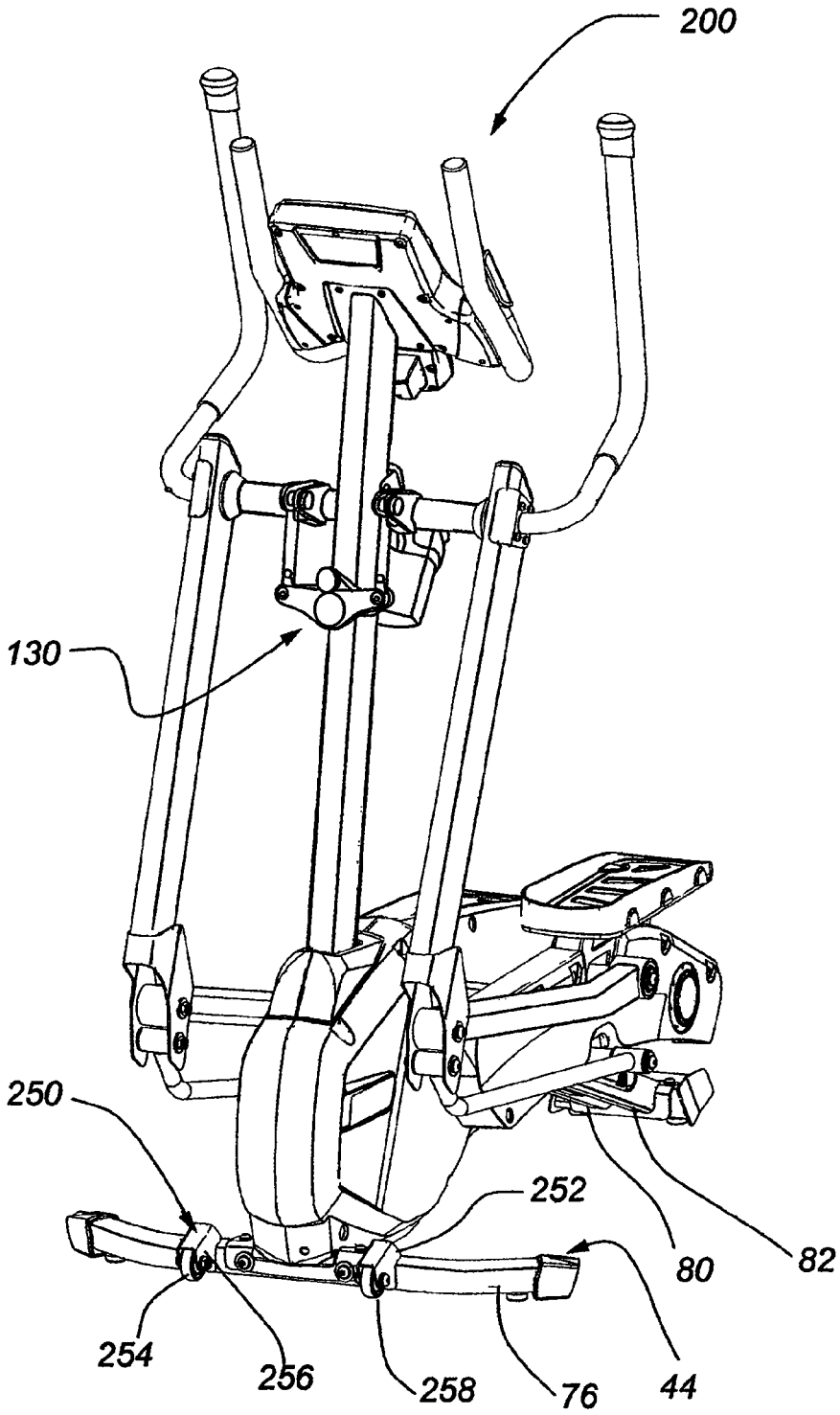
FIG. 25 depicts another perspective view of the exercise device shown in FIG. 17.
Figure 26:
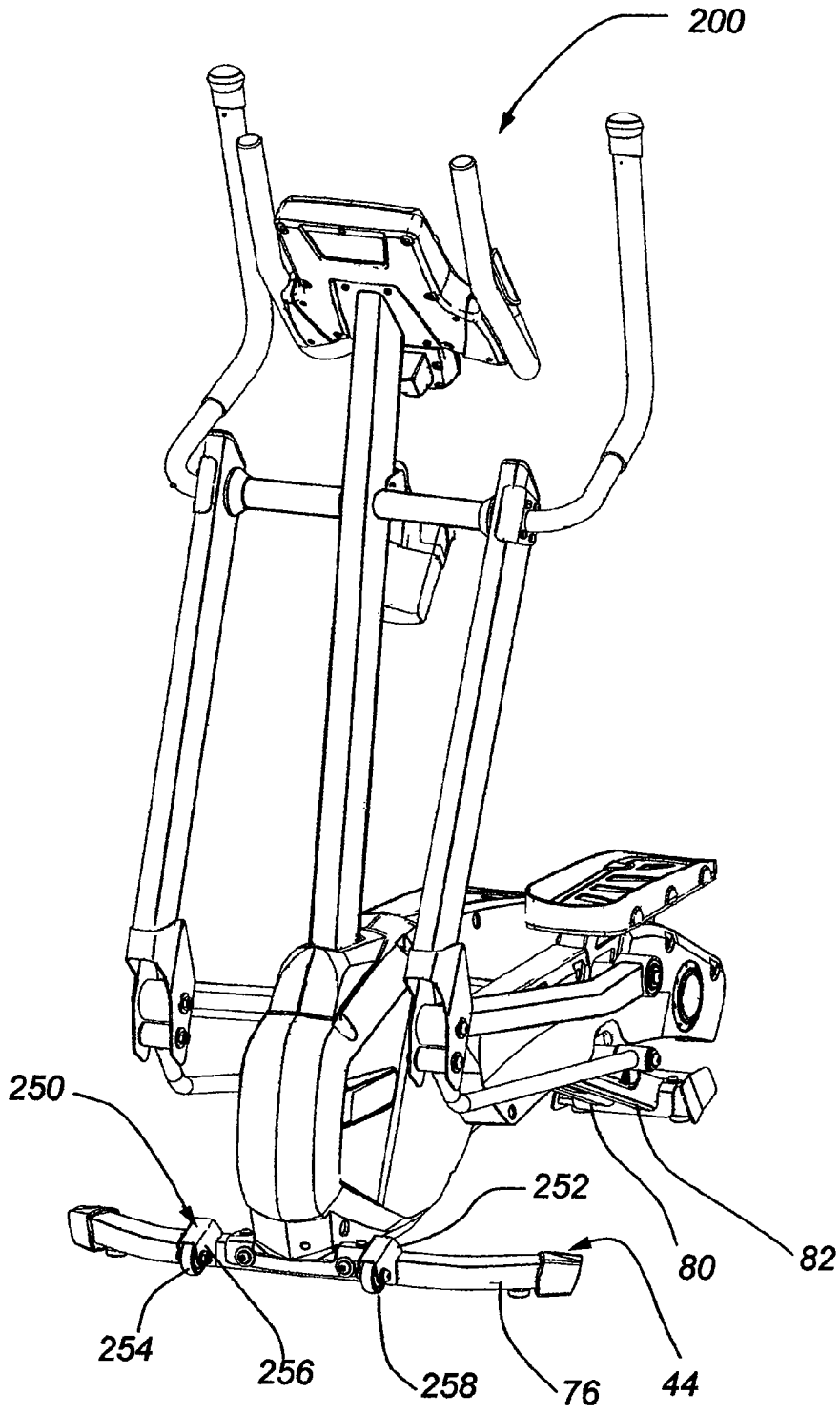
FIG. 26 depicts a perspective view similar to the view shown in FIG. 26 showing the exercise device without an interconnection assembly.

FIG. 25 shows another perspective view of the exercise device 200 shown in FIG. 17, and FIG. 26 shows a similar perspective view as the view shown in FIG. 25 except the exercise device is shown without an interconnect mechanism. With reference to FIG. 25, the exercise device may include an interconnect or dependency assembly 130. The interconnection assembly 130 may be the same or substantially similar to the one described above with respect the first embodiment of an exercise apparatus 100. However, as also described above and as shown in FIG. 26, the interconnect assembly may be omitted if desired.

With continued reference to FIGS. 25 and 26, the exercise device 200 may include right and left transport wheel assemblies 250, 252 for aiding in moving an assembled exercise device 200 from one location to another location. More particularly, the right transport wheel assembly may include a right transport wheel 254 rotatably attached to the frame 44 using a right transport wheel housing 256 attached to the front base component 76. Specifically, the right transport wheel 254 may be received within an opening defined by the right transport wheel housing 256 and joined thereto using a transport wheel pivot axle or other member suitable for rotatably joining the right transport wheel 254 to the right transport wheel housing 256. The right transport wheel housing 256, in turn, may be joined by welds or another known connection method to the front base component 76, thus operatively joining the right transport wheel 254 to the frame 44. The left transport wheel assembly 252 may be substantially similar to the right transport wheel assembly 250 and joined to the exercise device 200 in a similar manner.

To move the exercise device 200 using the right and left transport wheel assemblies 250, 252, the back end of the exercise device 200 may be pivoted upward around the front base component 76 to lift at least a back portion of the exercise device 200 off the surface supporting the exercise machine 200, thus reducing the frictional resistance between the support surface and exercise apparatus 200. Yet further, as shown in FIGS. 17, 18 and 25, the right and left lateral support components 80, 82 may be curved up and away from the support surface within at least a middle portion of these components 80, 82, thus further reducing the contact area between the support surface and the exercise device 200. Once at least the back portion is lifted from the surface, the front portion of the exercise device 200 may be at least partially supported by the right and left transport wheels 254, 258. The right and left transport wheels 254, 258 may then be used to roll the exercise device 200 to another location. Once at this desired location, the back end of the exercise device 200 may be located to the support surface, thus increasing the resistance between the exercise device 200 and the support surface, which helps to maintain the exercise frame 44 in a substantially stationary position relative to the support surface.

All directional references (e.g., upper, lower, upward, downward, left, right, leftward, rightward, top, bottom, above, below, inner, outer, vertical, horizontal, clockwise, and counterclockwise) are only used for identification purposes to aid the reader's understanding of the example of the invention, and do not create limitations, particularly as to the position, orientation, or use of the invention unless specifically set forth in the claims. Joinder references (e.g., attached, coupled, connected, joined, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like.

In methodologies directly or indirectly set forth herein, various steps and operations are described in one possible order of operation, but those skilled in the art will recognize that steps and operations may be rearranged, replaced, or eliminated or have other steps inserted without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. An exercise device comprising:

first and second rotatable members;

first and second swing members;

a first cam member operatively associated with the first rotatable member, the first cam member including a first at least partially curved rotatable member engagement surface engaged with the first rotatable member and selectively movable relative to the first rotatable member;

a second cam member operatively associated to the second rotatable member, the second cam member including a second at least partially curved rotatable member engagement surface engaged with the second rotatable member and selectively movable relative to the second rotatable member;

a first foot engagement member operatively associated with the first cam member;

a second foot engagement member operatively associated with the second cam member;

a first link member extending from the first swing member to the first cam member, the first link member pivotally associated with the first cam member at a first location between the ends of the first rotatable member engagement surface and operatively associated with the first swing member;

a second link member extending from the first swing member to the first cam member, the second link member pivotally associated with the first cam member at a second location between the ends of the first rotatable member engagement surface and operatively associated with the first swing member;

a third link member extending from the second swing member to the second cam member, the third link member pivotally associated with the second cam member at a third location between the ends of the second rotatable member engagement surface and operatively associated with the second swing member; and a fourth link member extending from the second swing member to the second cam member, the fourth link member pivotally associated with the second cam member at a fourth location between the ends of the second rotatable member engagement surface and operatively associated with the second swing member; wherein:

a user may move the first foot engagement member in a first variable pathway and may move the second foot engagement member in a second variable pathway; and the first link member is operatively associated with the first swing member at a fifth location, the second link member is operatively associated with the first swing member at a sixth location, and a minimum distance between the first and second locations is greater than a minimum distance between the fifth and sixth locations.

2. The exercise device of claim 1, wherein the first and second foot engagement members are connected with the first and second cam members, respectively.

3. The exercise device of claim 1, wherein the first and second foot engagement members are connected with the first and third link members, respectively.

4. The device of claim 1, wherein the first foot engagement member includes a first end, a second end distal the first end, and a portion between the first and second ends configured for engagement with a foot of the user; and the first end of the first foot engagement member is positioned higher than the second end of the first foot engagement member during a portion of the first variable pathway and the first end of the first foot engagement member is positioned lower than the second end of the first foot engagement member during another portion of the first variable pathway.

5. The device of claim 1, further comprising at least two risers joined to the first foot engagement member, the at least two risers positioning the first foot engagement member a predetermined distance above the first cam member.

6. The device of claim 1, further comprising a connection member joined to the first foot engagement member and the first cam member, the connection member positioning the first foot engagement member a predetermined distance above the first cam member.

7. The device of claim 6, wherein the connection member comprises a plate.

8. The exercise device of claim 1, wherein the first link member, the second link member and the first foot engagement member are configured so that an angle of the first foot engagement member relative to a horizontal plane changes as the first foot engagement member moves through the first variable pathway.

9. An exercise device comprising:

first and second rotatable members;

first and second swing members;

a first cam member operatively associated with the first rotatable member, the first cam member including a first at least partially curved rotatable member curved engagement surface engaged with the first rotatable member and selectively movable relative to the first rotatable member, the first rotatable member engagement surface including first and second ends, the first end of the first rotatable member engagement surface closer to the first swing member than the second end of the first rotatable member engagement surface;

a second cam member operatively associated with the second rotatable member, the second cam member including a second at least partially curved rotatable member engagement surface engaged with the second rotatable member and selectively movable relative to the second rotatable member, the second rotatable member engagement surface including first and second ends, the first end of the second rotatable member engagement surface closer to the second swing member than the second end of the second rotatable member engagement surface;

a first foot engagement member operatively associated with the first cam member;

a second foot engagement member operatively associated with the second cam member;

a first link member extending from the first swing member to the first cam member, the first link member pivotally associated with the first cam member at a first location farther from the first swing member than the first end of the first rotatable member engagement surface and operatively associated with the first swing member;

a second link member extending from the first swing member to the first cam member, the second link member pivotally associated with the first cam member at a second location farther from the first swing member than the first end of the first rotatable member engagement surface and operatively associated with the first swing member;

a third link member extending from the second swing member to the second cam member, the third link member pivotally associated with the second cam member at a third location farther from the second swing member than the first end of the second rotatable member engagement surface and operatively associated with the second swing member; and a fourth link member extending from the second swing member to the second cam member, the fourth link member pivotally associated with the second cam member at a fourth location farther from the second swing member than the first end of the second rotatable member engagement surface and operatively associated with the second swing member; wherein:

a user may move the first foot engagement member in a first variable pathway and may move the second foot engagement member in a second variable pathway; and the first link member is operatively associated with the first swing member at a fifth location, the second link member is pivotally associated with the first swing member at a sixth location, and a minimum distance between the first and second locations is greater than a minimum distance between the fifth and sixth locations.

10. The exercise device of claim 9, wherein the first location is between the first and second ends of the first cam member.

11. The exercise device of claim 9, wherein the first foot engagement member includes first and second ends, the first end of the first foot engagement member closer to the first swing member than the second end of the first foot engagement member, and the first end of the first rotatable member engagement surface closer to the first swing member than the first end of the first foot engagement member.

12. The exercise device of claim 11, wherein the first location is farther from the first swing member than the first end of the first foot engagement member.

13. The exercise device of claims 11, wherein the second location is farther from the first swing member than the first end of the first foot engagement.

14. The exercise device of claim 9, wherein the second foot engagement member includes first and second ends, the first end of the second foot engagement member closer to the second swing member than the second end of the second foot engagement member, and the first end of the second rotatable member engagement surface closer to the second swing member than the first end of the second foot engagement member.

15. The exercise device of claim 14, wherein the third location is farther from the second swing member than the first end of the second foot engagement member.

16. The exercise device of claims 14, wherein the fourth location is farther from the second swing member than the first end of the second foot engagement.

17. The device of claim 9, wherein the first foot engagement member is connected with the first cam member.

18. The device of claim 9, wherein the first foot engagement member is connected with the first link member.

19. The device of claim 9, wherein the first foot engagement member includes a first end, a second end distal the first end, and a portion between the first and second ends configured for engagement with a foot of the user; and the first end of the first foot engagement member is positioned higher than the second end of the first foot engagement member during a portion of the first variable pathway and the first end of the first foot engagement member is positioned lower than the second end of the first foot engagement member during another portion of the first variable pathway.

20. The device of claim 9, further comprising at least two risers joined to the first foot engagement member, the at least two risers positioning the first foot engagement member a predetermined distance above the first cam member.

21. The device of claim 9, further comprising a connection member joined to the first foot engagement member and the first cam member, the connection member positioning the first foot engagement member a predetermined distance above the first cam member.

22. The device of claim 21, wherein the connection member comprises a plate.

23. The exercise device of claim 9, wherein the first link member, the second link member and the first foot engagement member are configured so that an angle of the first foot engagement member relative to a horizontal plane changes as the first foot engagement member moves through the first variable pathway.

24. An exercise device comprising:

first and second rotatable members;

first and second swing members;

a first cam member operatively associated with the first rotatable member, the first cam member including a first at least partially curved rotatable member engagement surface engaged with the first rotatable member and selectively movable relative to the first rotatable member;

a second cam member operatively associated to the second rotatable member, the second cam member including a second at least partially curved rotatable member engagement surface engaged with the second rotatable member and selectively movable relative to the second rotatable member;

a first foot engagement member operatively associated with the first cam member;

a second foot engagement member operatively associated with the second cam member;

a first link member extending from the first swing member to the first cam member, the first link member pivotally associated with the first cam member at a first location between the ends of the first rotatable member engagement surface and operatively associated with the first swing member;

a second link member extending from the first swing member to the first cam member, the second link member pivotally associated with the first cam member at a second location between the ends of the first rotatable member engagement surface and operatively associated with the first swing member;

a third link member extending from the second swing member to the second cam member, the third link member pivotally associated with the second cam member at a third location between the ends of the second rotatable member engagement surface and operatively associated with the second swing member;

a fourth link member extending from the second swing member to the second cam member, the fourth link member pivotally associated with the second cam member at a fourth location between the ends of the second rotatable member engagement surface and operatively associated with the second swing member;

a connection member joined to the first foot engagement member and the first cam member, the connection member positioning the first foot engagement member a predetermined distance above the first cam member; and the second link member is pivotally associated with the first cam member by pivotally connecting the second link member to the connection member, wherein:

a user may move the first foot engagement member in a first variable pathway and may move the second foot engagement member in a second variable pathway.

25. The exercise device of claim 24, wherein the first link member, the second link member and the first foot engagement member are configured so that an angle of the first foot engagement member relative to a horizontal plane changes as the first foot engagement member moves through the first variable pathway.

26. The exercise device of claim 24, wherein the first foot engagement member includes a first end, a second end distal the first end, and a portion between the first and second ends configured for engagement with a foot of the user; and the first end of the first foot engagement member is positioned higher than the second end of the first foot engagement member during a portion of the first variable pathway and the first end of the first foot engagement member is positioned lower than the second end of the first foot engagement member during another portion of the first variable pathway.

27. An exercise device comprising:

first and second rotatable members;

first and second swing members;

a first cam member operatively associated with the first rotatable member, the first cam member including a first at least partially curved rotatable member curved engagement surface engaged with the first rotatable member and selectively movable relative to the first rotatable member, the first rotatable member engagement surface including first and second ends, the first end of the first rotatable member engagement surface closer to the first swing member than the second end of the first rotatable member engagement surface;

a second cam member operatively associated with the second rotatable member, the second cam member including a second at least partially curved rotatable member engagement surface engaged with the second rotatable member and selectively movable relative to the second rotatable member, the second rotatable member engagement surface including first and second ends, the first end of the second rotatable member engagement surface closer to the second swing member than the second end of the second rotatable member engagement surface;

a first foot engagement member operatively associated with the first cam member;

a second foot engagement member operatively associated with the second cam member;

a first link member extending from the first swing member to the first cam member, the first link member pivotally associated with the first cam member at a first location farther from the first swing member than the first end of the first rotatable member engagement surface and operatively associated with the first swing member;

a second link member extending from the first swing member to the first cam member, the second link member pivotally associated with the first cam member at a second location farther from the first swing member than the first end of the first rotatable member engagement surface and operatively associated with the first swing member;

a third link member extending from the second swing member to the second cam member, the third link member pivotally associated with the second cam member at a third location farther from the second swing member than the first end of the second rotatable member engagement surface and operatively associated with the second swing member;

a fourth link member extending from the second swing member to the second cam member, the fourth link member pivotally associated with the second cam member at a fourth location farther from the second swing member than the first end of the second rotatable member engagement surface and operatively associated with the second swing member;

a connection member joined to the first foot engagement member and the first cam member, the connection member positioning the first foot engagement member a predetermined distance above the first cam member; and the second link member is pivotally associated with the first cam member by pivotally connecting the second link member to the connection member, wherein:

a user may move the first foot engagement member in a first variable pathway and may move the second foot engagement member in a second variable pathway.

28. The exercise device of claim 27, wherein the first link member, the second link member and the first foot engagement member are configured so that an angle of the first foot engagement member relative to a horizontal plane changes as the first foot engagement member moves through the first variable pathway.

29. The exercise device of claim 27, wherein the first foot engagement member includes a first end, a second end distal the first end, and a portion between the first and second ends configured for engagement with a foot of the user; and the first end of the first foot engagement member is positioned higher than the second end of the first foot engagement member during a portion of the first variable pathway and the first end of the first foot engagement member is positioned lower than the second end of the first foot engagement member during another portion of the first variable pathway.

* * * * *